US006021883A

United States Patent [19]

Casanova et al.

[11] Patent Number: 6,021,883

[45] **Date of Patent: *Feb. 8, 2000**

[54] FUNDS PROCESSING SYSTEM

[75] Inventors: Scott D. Casanova, Roselle; Joseph J. Geib, Mt. Prospect; William J. Jones, Kenilworth; Steve S. Kuhlin, Lake Zurich; Richard A. Mazur, Naperville; Douglas U. Mennie, Barrington; Mark C. Munro, Park Ridge, all of Ill.

[73] Assignee: Cummins Allison, Corp., Mt. Prospect, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/756,167

[22] Filed: Nov. 25, 1996

[51] Int. Cl.[7] ..... G07D 3/16

[52] U.S. Cl. ..... 194/217; 194/348

[58] Field of Search ..... 194/206, 207, 194/217, 218, 347, 348, 320, 325; 235/379

[56] References Cited

U.S. PATENT DOCUMENTS

| | | | |
|---|---|---|---|
| D. 369,984 | 5/1996 | Larsen | D10/97 |
| 446,303 | 2/1891 | Thompson | 195/325 X |
| 2,669,998 | 2/1954 | Buchholz . | |
| 2,750,949 | 6/1956 | Kulo et al. . | |
| 2,835,260 | 5/1958 | Buchholz . | |
| 3,800,078 | 3/1974 | Cochran et al. | 178/7.1 |
| 4,114,807 | 9/1978 | Jones et al. | 194/207 X |
| 4,205,780 | 6/1980 | Burns et al. | 235/454 |
| 4,264,808 | 4/1981 | Owens et al. | 235/379 |
| 4,360,034 | 11/1982 | Davila et al. . | |
| 4,383,540 | 5/1983 | DeMeyer et al. | 453/3 |
| 4,386,432 | 5/1983 | Nakamura et al. | 382/7 |
| 4,396,902 | 8/1983 | Warthan et al. | 382/64 |
| 4,543,969 | 10/1985 | Rasmussen . | |
| 4,743,974 | 5/1988 | Lockwood | 358/285 |
| 4,782,328 | 11/1988 | Denlinger | 340/365 |
| 4,806,709 | 2/1989 | Evans | 178/19 |
| 4,811,004 | 3/1989 | Person et al. | 340/712 |
| 4,821,332 | 4/1989 | Durham | 382/7 |
| 4,837,842 | 6/1989 | Holt | 382/26 |
| 4,851,616 | 7/1989 | Wales et al. | 178/18 |
| 4,888,812 | 12/1989 | Dinan et al. | 382/7 |
| 4,928,094 | 5/1990 | Smith | 340/712 |
| 4,931,782 | 6/1990 | Jackson | 340/706 |
| 5,023,782 | 6/1991 | Lutz et al. | 364/405 |
| 5,063,599 | 11/1991 | Concannon et al. | 382/7 |
| 5,091,961 | 2/1992 | Baus, Jr. | 382/7 |
| 5,105,601 | 4/1992 | Horiguchi et al. | 53/465 |
| 5,114,381 | 5/1992 | Ueda et al. | 453/57 |
| 5,134,663 | 7/1992 | Kozlowski | 382/7 |
| 5,146,512 | 9/1992 | Weideman et al. | 382/30 |
| 5,154,272 | 10/1992 | Nishiumi et al. | 194/217 X |

(List continued on next page.)

FOREIGN PATENT DOCUMENTS

| | | |
|---|---|---|
| 0 325 364 A2 | 7/1989 | European Pat. Off. . |
| WO 94/19773 | 9/1994 | WIPO . |
| WO 95/24691 | 9/1995 | WIPO . |
| WO 96/10800 | 4/1996 | WIPO . |

OTHER PUBLICATIONS

Barton, Louis L., "Check Processing Operations," Chapter 8 and Appendix 2, 1994, pp. 119–140 and 225–231.

*Primary Examiner*—F. J. Bartuska
*Attorney, Agent, or Firm*—Arnold White & Durkee

[57] ABSTRACT

A funds discrimination and sorting system comprises an acceptor for accepting mixed currency from a customer. A sorter and discriminator sorts and discriminates the funds by denomination, the sorter and discriminator are coupled to the acceptor. An interface is coupled to the sorter and discriminator for accepting instructions from a customer, the instructions causing the actuation of the system; and an attendant control panel allows an attendant to operate the system in a plurality of modes, the attendant control panel is positioned opposite and is inaccessible from said customer interface.

16 Claims, 22 Drawing Sheets

U.S. PATENT DOCUMENTS

| | | | |
|---|---|---|---|
| 5,163,672 | 11/1992 | Mennie | 271/187 |
| 5,163,868 | 11/1992 | Adams et al. | 453/11 |
| 5,184,115 | 2/1993 | Black et al. | 340/708 |
| 5,187,750 | 2/1993 | Behera | 382/7 |
| 5,193,121 | 3/1993 | Elischer et al. | 382/7 |
| 5,198,976 | 3/1993 | Form et al. | 364/410 |
| 5,207,788 | 5/1993 | Geib et al. | 271/122 |
| 5,231,381 | 7/1993 | Duwaer | 340/712 |
| 5,237,158 | 8/1993 | Kern et al. | 235/379 |
| 5,239,593 | 8/1993 | Wittner et al. | 382/14 |
| 5,286,954 | 2/1994 | Sato et al. | 235/379 |
| 5,297,030 | 3/1994 | Vassigh et al. | 364/405 |
| 5,317,140 | 5/1994 | Dunthorn | 250/221 |
| 5,321,238 | 6/1994 | Kamata et al. | 235/379 |
| 5,335,292 | 8/1994 | Lovelady et al. | 382/17 |
| 5,341,408 | 8/1994 | Melcher et al. | 377/8 |
| 5,363,949 | 11/1994 | Matsubayashi | 194/206 |
| 5,381,019 | 1/1995 | Sato | 250/556 |
| 5,430,664 | 7/1995 | Cargill et al. | 364/550 |
| 5,444,793 | 8/1995 | Kelland | 382/138 |
| 5,465,301 | 11/1995 | Jotcham et al. | 380/54 |
| 5,467,405 | 11/1995 | Raterman et al. | 382/135 |
| 5,530,772 | 6/1996 | Storey | 382/135 |
| 5,544,043 | 8/1996 | Miki et al. | 364/406 |
| 5,564,546 | 10/1996 | Molbak et al. | 194/347 |
| 5,602,936 | 2/1997 | Green et al. | 382/140 |
| 5,607,040 | 3/1997 | Mathurin, Sr. | 194/207 |
| 5,633,949 | 5/1997 | Graves et al. | 382/135 |
| 5,640,463 | 6/1997 | Csulits | 382/135 |

FIG. 5a

SETUP MAIN MENU

- ENABLE KEYS
- ENABLE FUNCTIONS
- DATA ENTRY SELECTIONS
- PORT SETUP
- DISCRIMINATOR LEARN

HELP MORE EXIT

FIG. 5b

SETUP MAIN MENU

- USER DEFAULTS
- BOX/BAG CONFIGURATIONS
- REPOSITION KEYS
- KEY LEGENDS
- LUBRICATION

HELP BACK EXIT

FIG. 5c

SELECT DIAGNOSTIC TEST:

- MEMORY INFORMATION
- ENCODER & COIN SENSORS
- KEYBOARD
- MOTOR
- COIN THRUPUT

HELP MORE EXIT

FIG. 5d

SELECT DIAGNOSTIC TEST:

- COIN STOP
- BRAKE CYCLE
- COMM PORTS
- REMOTE DISPLAY
- MACHINE STATISTICS

HELP BACK EXIT

FIG. 6a

PLACE COINS IN TRAY AND PRESS START

START HELP

FIG. 6b $ 00,000.00

LIFT TRAY SLOWLY

HELP

FIG. 6c $ 512.00

COUNTING....

HELP

FIG. 6d $ 575.00

DO YOU WISH TO COUNT MORE COIN ?

YES NO HELP

FIG. 6e $ 575.00

PRESS "ACCEPT" TO DISPENSE
DISPLAYED AMOUNT.

ACCEPT HELP

FIG. 6f $ 575.00

DISPENSING.... PLEASE WAIT

HELP

FUNDS PROCESSING SYSTEM

FIELD OF INVENTION

The present invention relates to currency processing systems such as automatic teller machines and currency redemption machines.

SUMMARY OF THE INVENTION

The primary object of the invention is to provide a currency processing system capable of processing mixed currency while allowing both customer and attendant access while maintaining system security.

It is yet another object of the invention to provide a system where deposits are processed substantially immediately.

It is a further object of the invention to provide an improved funds processing system that contains a liquid removal system for removing liquid spilled into the machine.

It is yet another object of the invention to provide an improved funds processing system that activates an alarm upon a request by a customer or upon detection of errors in system operation.

It is still another object of the invention to provide an improved funds processing system which prevents debris from being inserted into the system.

It is a further object of the invention to provide an improved funds processing system that is easy to use and maintain.

It is yet another object of the present invention to provide an improved funds processing system which allows customer access via a touch screen.

Other aspects and advantages of the present invention will become apparent upon reading the following detailed description and in reference to the drawings.

In accordance with the present invention, the foregoing objectives are realized by providing an improved funds processing system comprising acceptance means for accepting mixed funds from a customer; sorting and discrimination means for sorting and discriminating the funds by denomination, the sorting and discrimination means coupled to the acceptance means; customer interface means coupled to the sorting and discrimination means for accepting instructions from a customer, the instructions causing the actuation of said system; and attendant control means for allowing an attendant to operate said system in a plurality of modes, the attendant control means positioned opposite and inaccessible to said customer.

BRIEF DESCRIPTION OF THE DRAWINGS

FIGS. 5*a–d* are illustrative menus of the attendant display unit according to principles of the present invention;

FIGS. 6*a–f* are illustrative screens from the customer display according to principles of the present invention;

DESCRIPTION OF THE PREFERRED EMBODIMENT

Figure 1A:
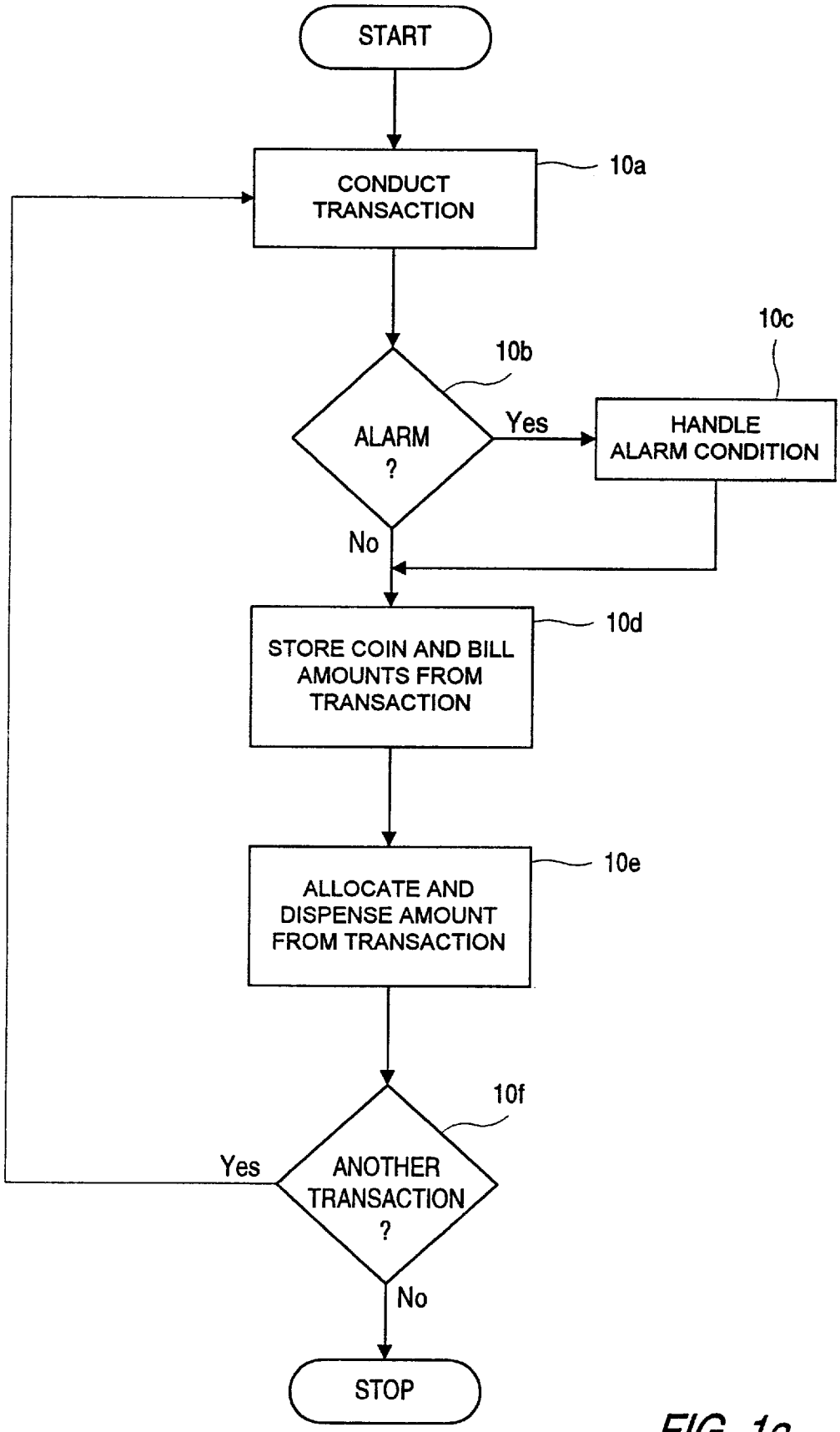
FIG. 1*a* shows a flowchart describing the operation of the improved funds processing system according to principles of the present invention.

While the invention is susceptible to various modifications and alternate forms, specific embodiments thereof have been shown by way of example in the drawings and will herein be described in detail. It should be understood, however, that it is not intended to limit the invention the particular forms disclosed, but on the contrary, the intention is to cover all modifications, equivalents, and alternatives falling within the spirit and scope of the invention as defined by the appended claims.

The operation of the improved funds processing system of the present invention is illustrated in FIG. 1*a*. The customer conducts a transaction at step 10*a*. The transaction in step 10*a* consists of conducting a coin transaction, bill transaction, storage media transaction, or a transaction with a financial account, all of which are described in greater detail below. By "coin," it is meant to include not only conventional coin such as quarters, but also other coin-like media such as tokens. "Coin" includes all denominations of U.S. and foreign coin. By "bill," it is meant to include not only conventional currency such as $1 bills, but also paper media or documents such as checks or various forms of customer script. "Bills" also includes all denominations of foreign bills such as British pound notes. By a "storage media transaction," it is meant to include a transaction which deposits funds from all forms of storage media including all forms of magnetic storage media (e.g., smart cards, debit cards), all forms of optical storage media (e.g., CD disks) and all forms of solid state storage media. Stored on the media is an amount indicating an amount of funds. The storage media may store either U.S. or foreign funds. By an "account transaction," it is meant to include depositing money directly from a credit card account, savings account, checking account, store account, or any other similar arrangement. The account may contain either U.S. or foreign funds.

An alarm condition may be generated during a transaction. At step 10*b*, the system determines whether an alarm condition is present. If the answer is affirmative, then at step 10*c* the system responds to the alarm condition. The response may be automatic or may require manual action by the customer. If the response is automatic, the system preferably flashes a warning light, for example a 24 VAC external light driven by a relay. Alternatively or additionally, the system may cycle the backlighting of an attendant screen on and off or sound an audio warning. If the response required is manual, the customer is required to perform some manual action, for example, changing the coin bags, and instructions of how to proceed may be displayed to the customer on a customer display screen, as described below. Alarm conditions occur when the customer presses a help key; when a currency dispenser becomes empty; when more than a programmable predetermined amount of foreign currency is detected; upon a system error condition; when the liquid container is full; when coins jam the opening of a bag; and when a bag is full. If the answer to step 10*b* is negative or upon completion of step 10*c*, operation continues at step 10*d*.

After the alarm condition is tested or handled, the amount deposited in the transaction is stored at step 10*d* for later use. The values are preferably stored in a computer memory. Next, at step 10*e*, the customer or machine distributes the deposited amount stored in step 10*d*. Step 10*e* is also described in greater detail below and can, for example, consist of receiving the deposited amount in the form of bills, allocating it to a savings account, or receiving part of the deposit back in bills and crediting the remainder to a bank savings account. At step 10*f*, the customer is given the choice of conducting a new transaction. If the answer is affirmative, the system returns to step 10*a* which is described above. If the customer answers in the negative, then the machine stops.

An improved funds processing system of the present invention is illustrated in FIGS. 1*b*, 1*c*, 1*d*, 1*e*, 1*f*, 1*g*, and 1*h*. The system shown conducts coin transactions only and comprises a coin sorting and discriminating unit 11 and a dispensing unit 12. The dispensing unit consists of a currency dispenser 48*a* and a coin dispenser 48*b*. However, as described in greater detail below, other units may be added to allow the system to conduct bill, storage media, and account transactions. Additionally, the coin sorting and discriminating unit 11 and dispensing unit 12 may be incorporated into a single unit.

As shown in FIGS. 1*b*–1*e*, the sorting and discriminating unit 11 and the currency dispensing unit 12 have customer sides 14*a* and 14*b* and attendant sides 16*a* and 16*b*, respectively. Although the two units appear as a stand-alone units, when in actual use, the units are housed in a permanent housing (not shown) which prevents the customer from accessing the attendant sides 16*a* and 16*b* of the units, thereby maintaining system security. The sorting and discriminating unit 11 communicates with dispensing unit 12 via a communications cable (not shown), as is well known in the art. The system may additionally communicate with an associated funds processing system, such as a bank account.

The customer sorts coins by placing the coins to be sorted into a coin lift tray 20 of the sorting and discriminating unit 11 and subsequently lifting the tray 20 using a handle 18. The tray 20 pivots when raised so that when it is elevated to its maximum height, the coins slide from the tray 20 into the coin hopper 26. The coin hopper 26 has a slanted back portion 36 (FIGS. 1*g* and 1*h*) composed of a magnetic material for catching metallic debris. The coin hopper 26 also has a cover 42. The cover 42 may pivot only simultaneously with the tray 20 as the tray 20 is lifted, or independently of the movement of the tray. The cover 42 is preferably padded internally with a suitable noise-reducing material so as to reduce noise from the internal parts of the machine. If the hopper cover 42 pivots with the tray, it also helps prevent customer access to the counting chamber in the interior of the machine. As shown specifically in FIGS. 1*g* and 1*h*, the user uses the handle 18 to raise the tray 20. The hopper cover 42 pivots upwardly simultaneously with the coin tray 20 until the edge 43*a* of the tray meets the edge 43*b* of the hopper 26. The coins 41 slide into the coin hopper 26 and fall through the coin chute 44 into the discriminating unit 45 where they are counted, discriminated, and bagged as described in U.S. Pat. No. 5,542,880 which is herein incorporated by reference in its entirety.

Figure 9:
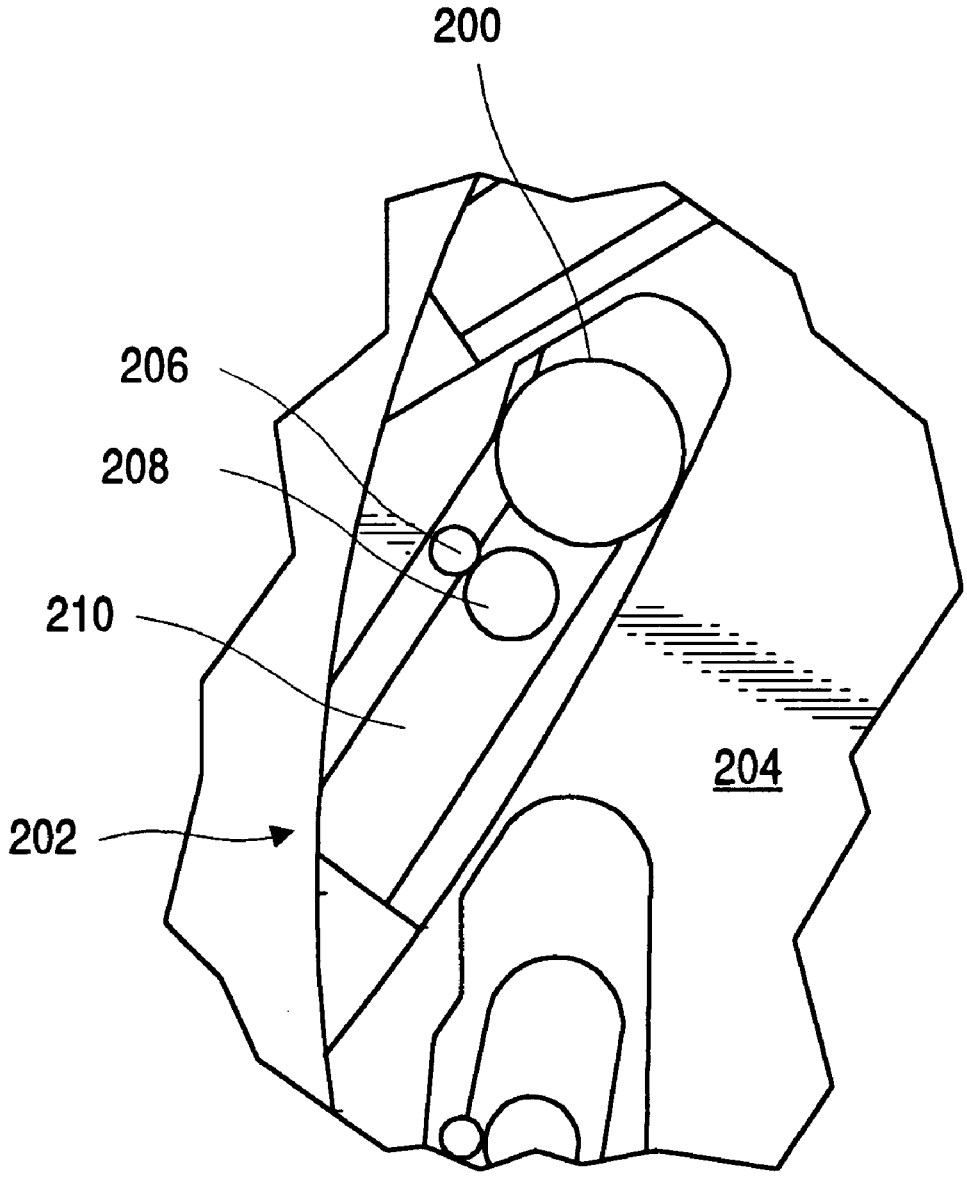
FIG. 9 is a detailed view of a portion of the sorting head.

As shown in FIG. 9, a coin 200 of a particular denomination enters the exit channel 202 of the sorting head 204. In order to prevent false invalidity readings from occurring, a counting sensor 206, turns on a discriminating sensor 208 in exit channel 210 when the counting sensor 206 detects a coin 200. Turning on the discriminating sensor 208 can be accomplished either directly or indirectly by having the counting sensor 206 signal a controller (not shown) and then having the controller activate the discriminating sensor.

Figure 1B:
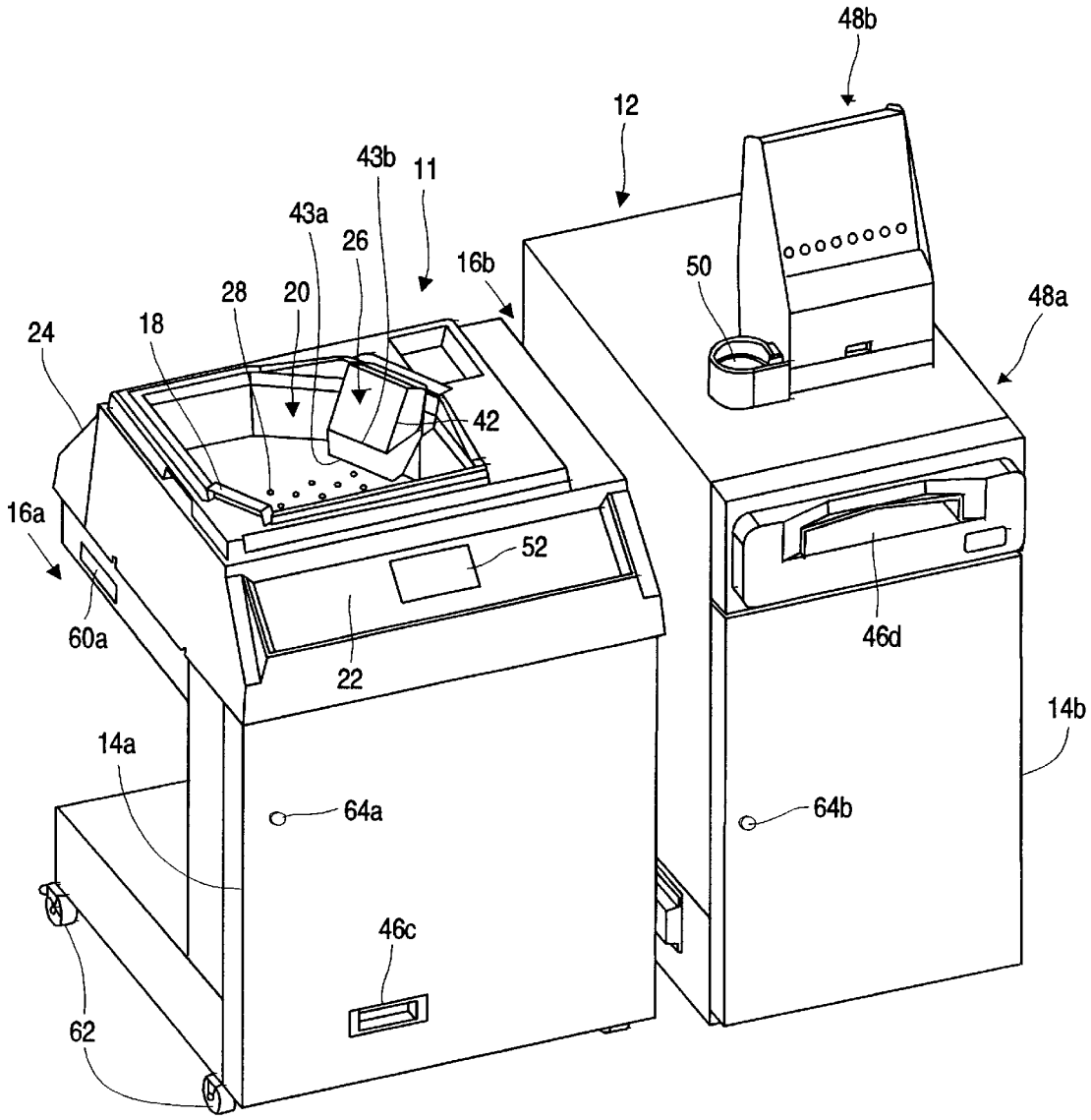
FIG. 1*b* is a perspective drawing showing an improved funds processing system according to principles of the present invention.
Figure 1C:
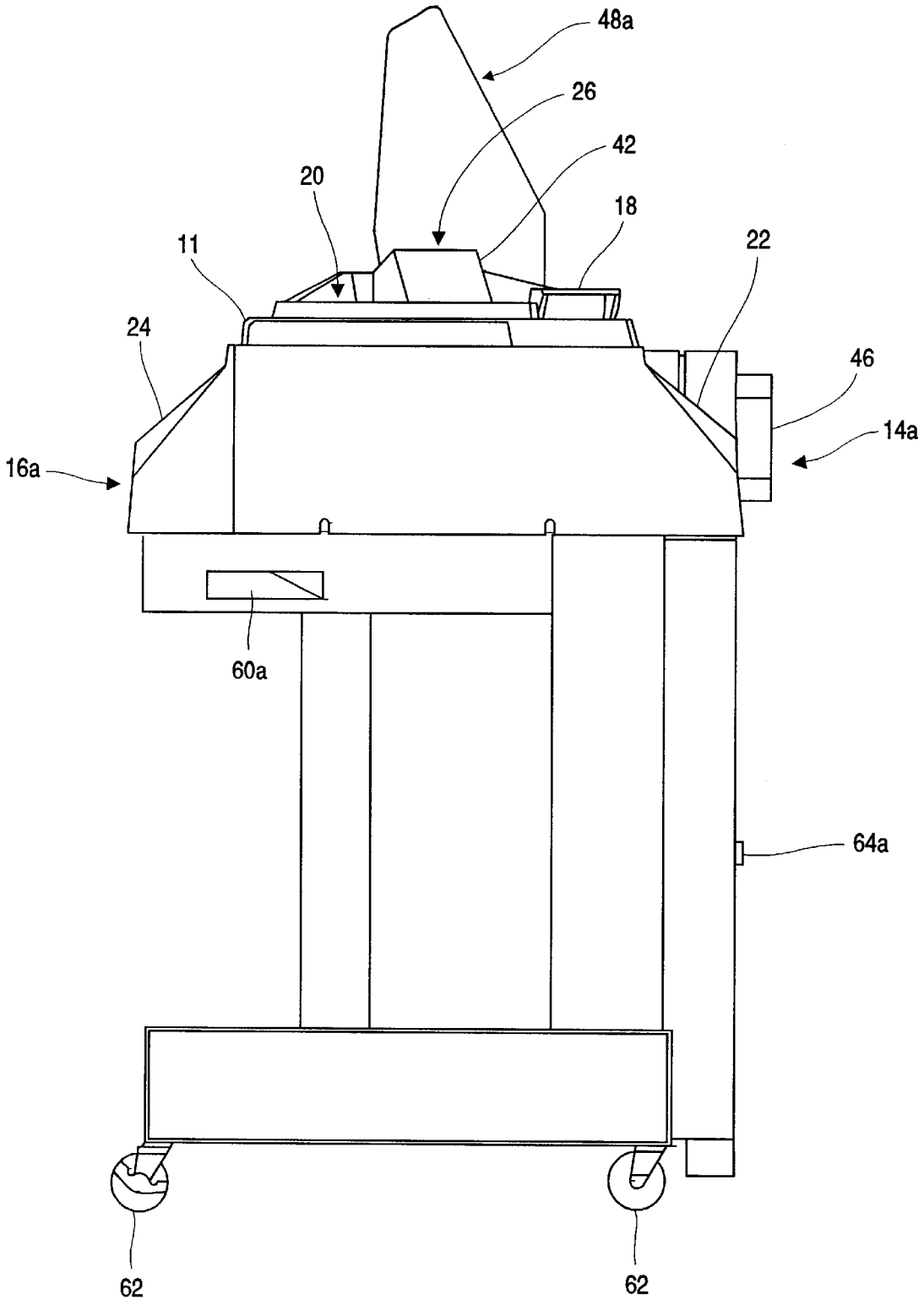
FIG. 1*c* is a side view of the funds processing system of FIG. 1*b* according to principles of the present invention.
Figure 1D:
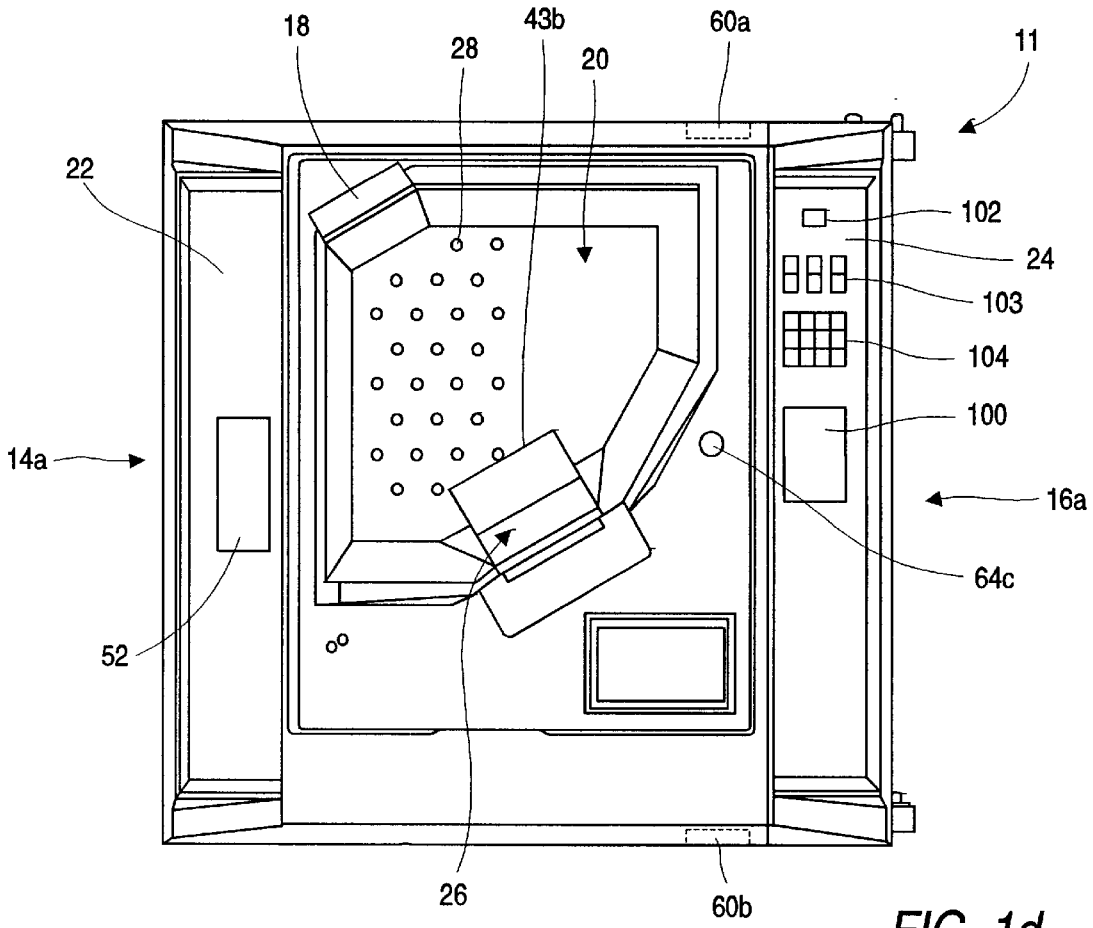
FIG. 1*d* is a top view of the funds processing system of FIG. 1*b* according to principles of the present invention.
Figure 1E:
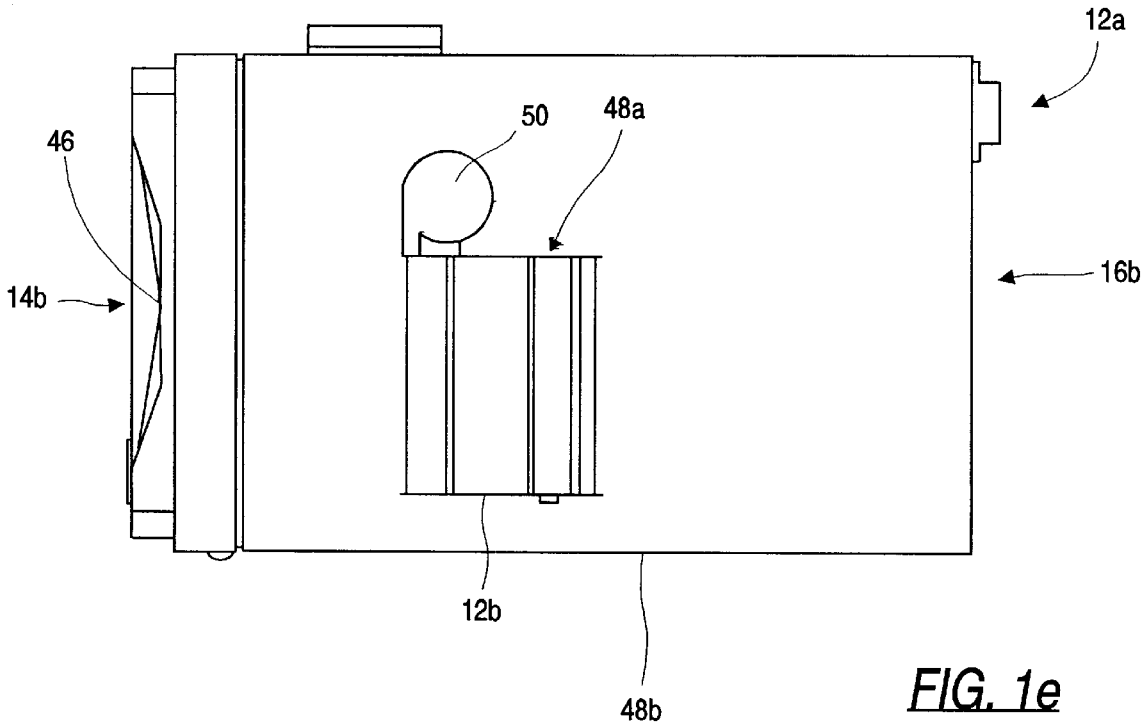
FIG. 1*e* is a cut-away view of the sorting unit according to principles of the present invention.
Figure 1F:
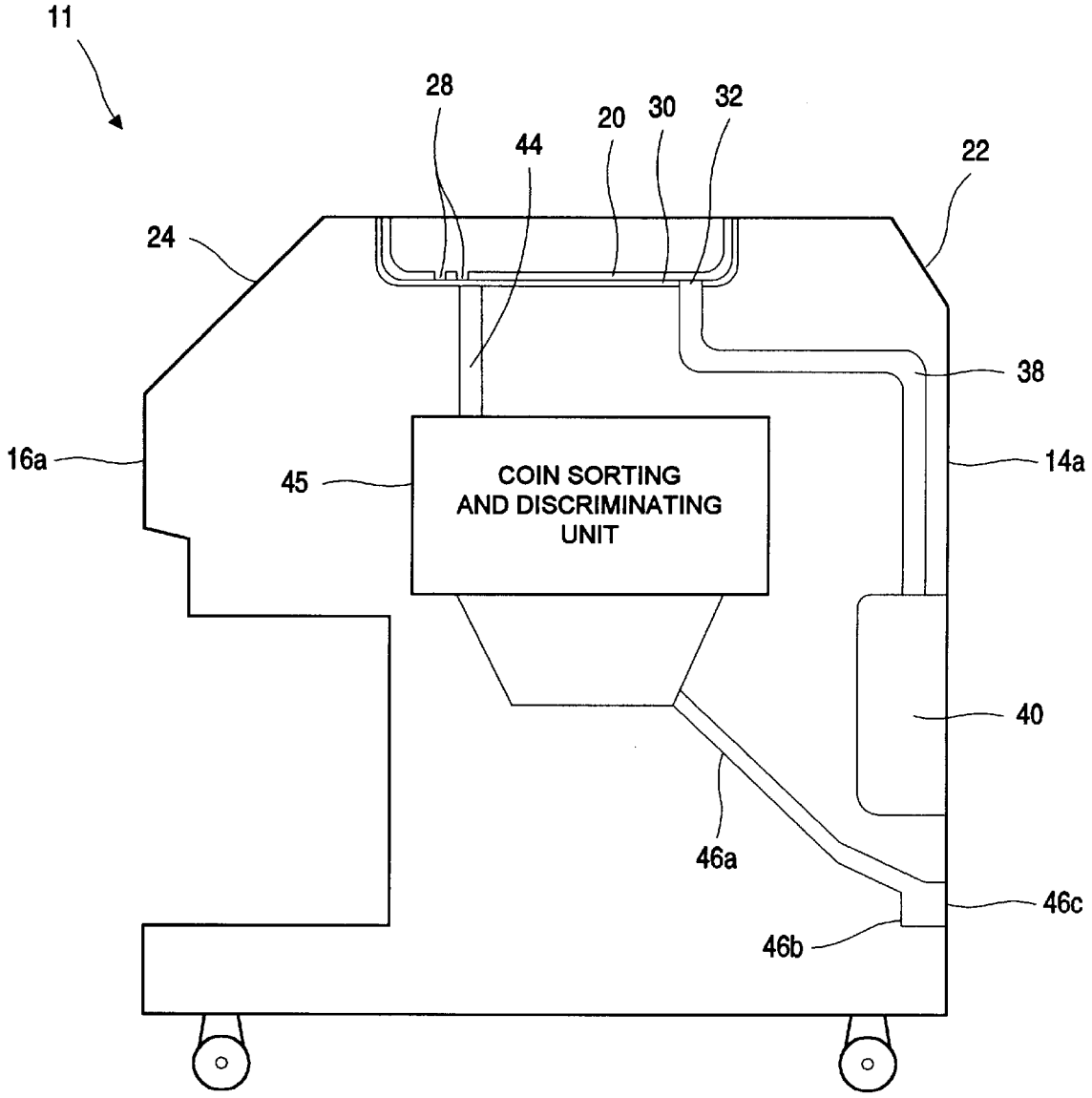
FIG. 1*f* is a cross-sectional view of the tray and coin hopper in a reclined position according to principles of the present invention.
Figure 1H:
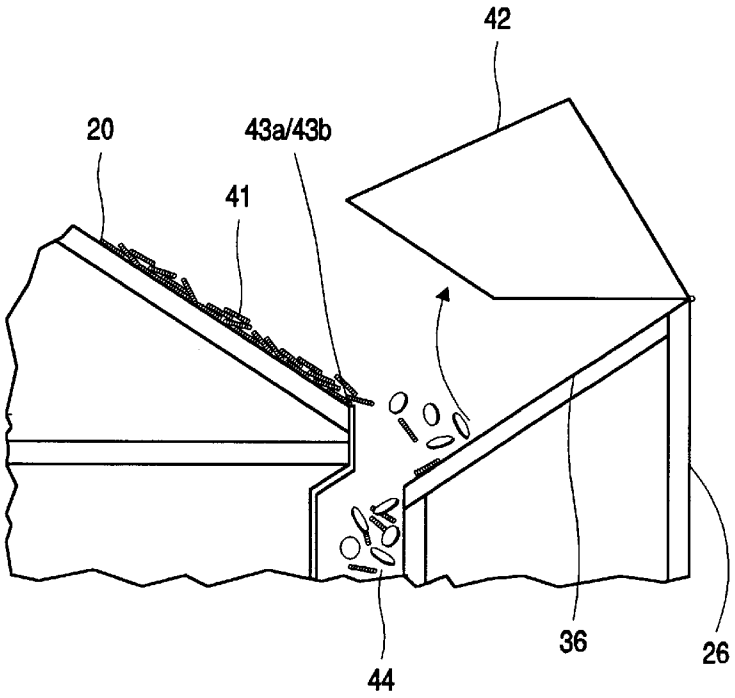
FIGS. 1*g* and 1*h* are cross-sectional views of the tray and hopper showing the tray in a reclined position and lifted with the coins falling into the hopper according to principles of the present invention.
Figure 1G:
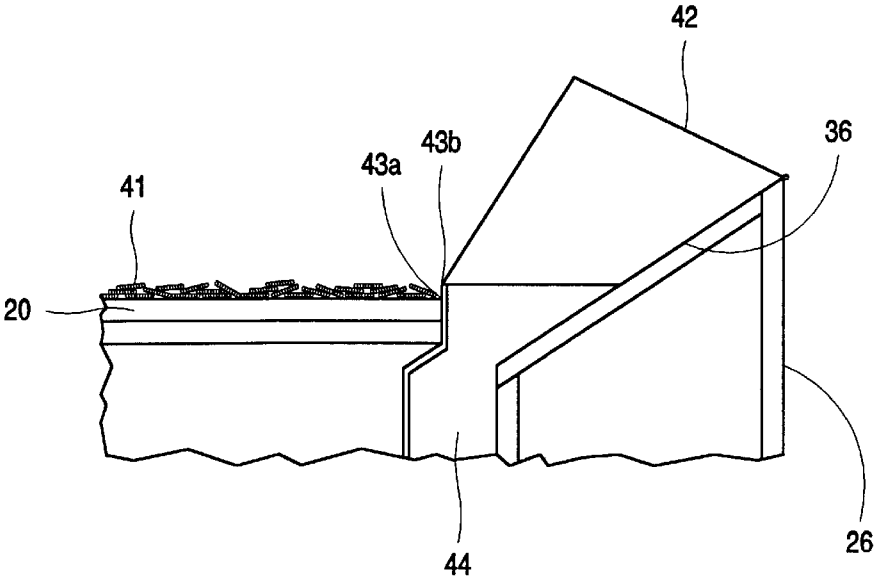

As shown in FIG. 1*f*, the tray 20 has debris holes 28 for the purpose of extracting debris from the tray 20. The debris falls through the holes 28 onto a cover 30 when the tray 20 is lifted. The cover 30 is immediately underneath the tray 20 and is shaped to hold the tray 20. The cover 30 shields the interior of the machine and has a drain 32. Also as shown in FIG. 1*f*, liquid flows through the debris holes 28, down drain 32 through a hose 38, and into a container 40, which preferably holds about one gallon of liquid.

As shown in FIG. 1*b*, a customer panel 22 on customer side 14*a* of the sorting and discriminating unit 11 faces and is accessible to the customer. An attendant panel 24 on attendant side 16*a* of the sorting and discriminating unit 11 faces and is accessible only to the attendant. The customer panel 22 comprises a touch screen 52 which is described in detail below. The display could, in addition to the touch screen, include a keypad.

As shown in FIG. 1*d*, the operator control panel 24 includes a main power switch 102 and a mechanical keyboard 101 which includes an arrangement of numerical keys 104 and an arrangement of basic function keys 103. Alternatively, it could use only a touch screen or a video screen and keypad. The operation of the touch screens 52 and 100 is described in greater detail below.

Upon detection of an alarm condition, the attendant touch screen 100 may be caused to cycle on and off to alert the attendant to the alarm condition. Also, the system can have a light which is flashed upon the detection of an alarm condition further alerting the attendant to the alarm condition. The system can also have an internal speaker which sounds an audio alert upon the detection. The audio alert may sound prerecorded sounds; alternatively, the attendant or owner may be able to record messages. Recording can be done by speaking directly into a built-in microphone or by connecting a cassette player or personal computer to the system. The volume of the sound is adjustable and adjusts automatically depending on the noise level in the environment surrounding the system.

A printer (not shown) may also be connected to the sorting and discriminating unit 11 and prints out the customer's transactions. The printer may be housed on a shelf on the attendant side 16*a* or any other side. The sorting and discriminating unit 11 could also have a slot for a customer identification card on the customer side 14*a*.

As shown in FIG. 1*f*, the sorting and discriminating unit 11 has a coin reject slot 46*c*. It rejects foreign coins back to the customer via a cup 46*b* on the customer side 14*a* of the sorting and discriminating unit 11. The coins that are rejected fall down a coin chute 46*a* into the rejected coin cup 46*b* which is accessible by the user through the coin return slot 46*c*. The cup 46*b* preferably holds a minimum of ten coins.

The sorting and discriminating unit 11 could use coin escrow, as described below. Alternatively, a message could be used asking the user whether they wish to accept the count or ask help from an attendant to manually recount the bag.

As shown in FIG. 1*b*, the distribution of the currency and coin to the customer is accomplished by the dispensing unit 12 which comprises the currency dispenser 48*a* and coin dispenser 48*b* which are machine programmed to dispense currency and coin in preset patterns. That is, when a deposit is made by the customer, the machine decides the allocation of funds returned to the customer. For example, if the customer deposited $20.15 in coin, the dispenser 12 may be programmed to return to the customer one $20 bill, one dime, and one nickel. However, as described in greater detail below, the machine may be programmed to allow a user to select the distribution pattern. A bill dispenser slot 46*d* on the currency dispenser 48*a* dispenses bills to the customer while a coin dispenser 48*b* dispenses coins to the customer in a coin dispensing tray 50.

As shown in FIGS. 1*b*–1*d*, gripping slots 60*a* and 60*b* and wheels 62 allow the user to easily move the sorting and discriminating unit 11. Locks 64*a*, 64*b*, and 64*c* prevent unauthorized access to the system.

Figure 2:
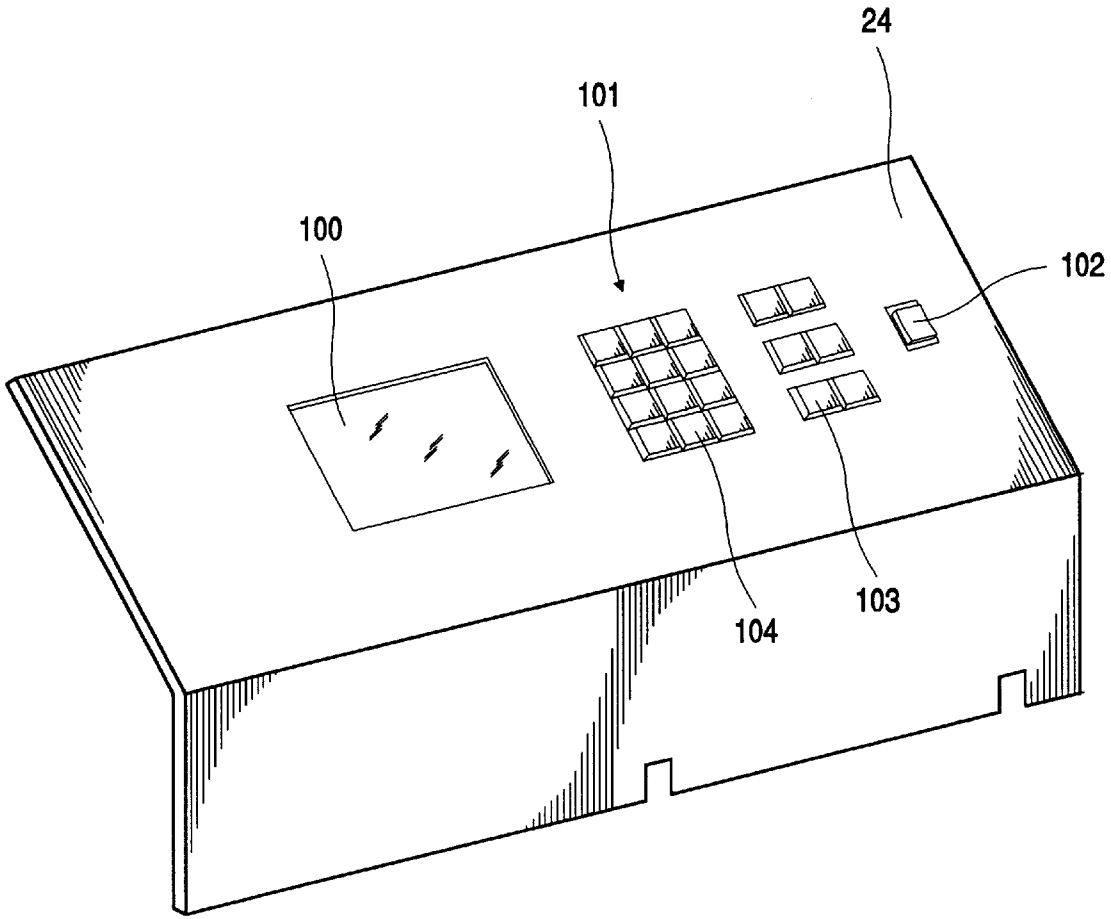
FIG. 2 is perspective view of the attendant panel according to principles of the present invention.

FIG. 2 illustrates the attendant control panel 24 of the sorting and discriminating unit 11 which an attendant utilizes to operate and control the improved funds processing system. The operator control panel 24 includes a main power switch 102 which powers the entire coin sorter. A mechanical keyboard 101 includes a plurality of keys which the operator depresses. Typically, the mechanical keyboard 101 includes an arrangement of numerical keys 104 and an arrangement of basic function keys 103. A touch screen device 100 is also utilized which makes the operator control panel 24 more user-friendly. Further, employing a touch screen device 100 provides the manufacturer with a great amount of versatility in that numerous types of displays and display keys can be configured.

Figure 3:
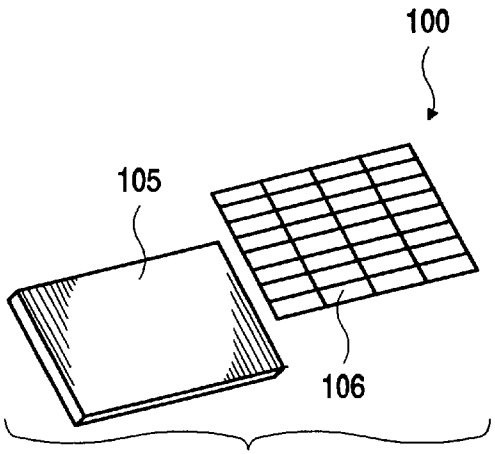
FIG. 3 is a perspective view of the touch screen device according to principles of the present invention.

The touch screen device 100, shown in FIG. 3, is preferably an X-Y matrix touch screen forming a matrix 106 of touch responsive points. The touch screen 100 includes two closely spaced but normally separated layers of optical grade polyester film each having a set of parallel transparent conductors. The sets of conductors in the two spaced polyester sheets are oriented at right angles to each other so when superimposed they form a grid. Along the outside edge of each polyester layer is a bus which interconnects the conductors supported on that layer.

In this manner, electrical signals from the conductors are transmitted to a controller. When pressure from a finger or stylus is applied to the upper polyester layer, the set of conductors mounted to the upper layer is deflected downward into contact with the set of conductors mounted to the lower polyester layer. The contact between these sets of conductors acts as a mechanical closure of a switch element to complete an electrical circuit which is detected by the controller through the respective buses at the edges of the two polyester layers, thereby providing a means for detecting the X and Y coordinates of the switch closure. A matrix touch screen 100 of the above type is commercially available from Dynapro Thin Film Products, Inc. of Milwaukee, Wis.

In the preferred embodiment, the touch screen 100 forms a matrix 106 of ninety-six optically transparent switch elements having six columns and sixteen rows. The matrix 106 is positioned over graphics display 105 which displays display keys. The incorporation of touch screen technology in coin sorters is further described in U.S. Pat. No. 5,564,974 which is herein incorporated by reference in its entirety.

Figure 4:
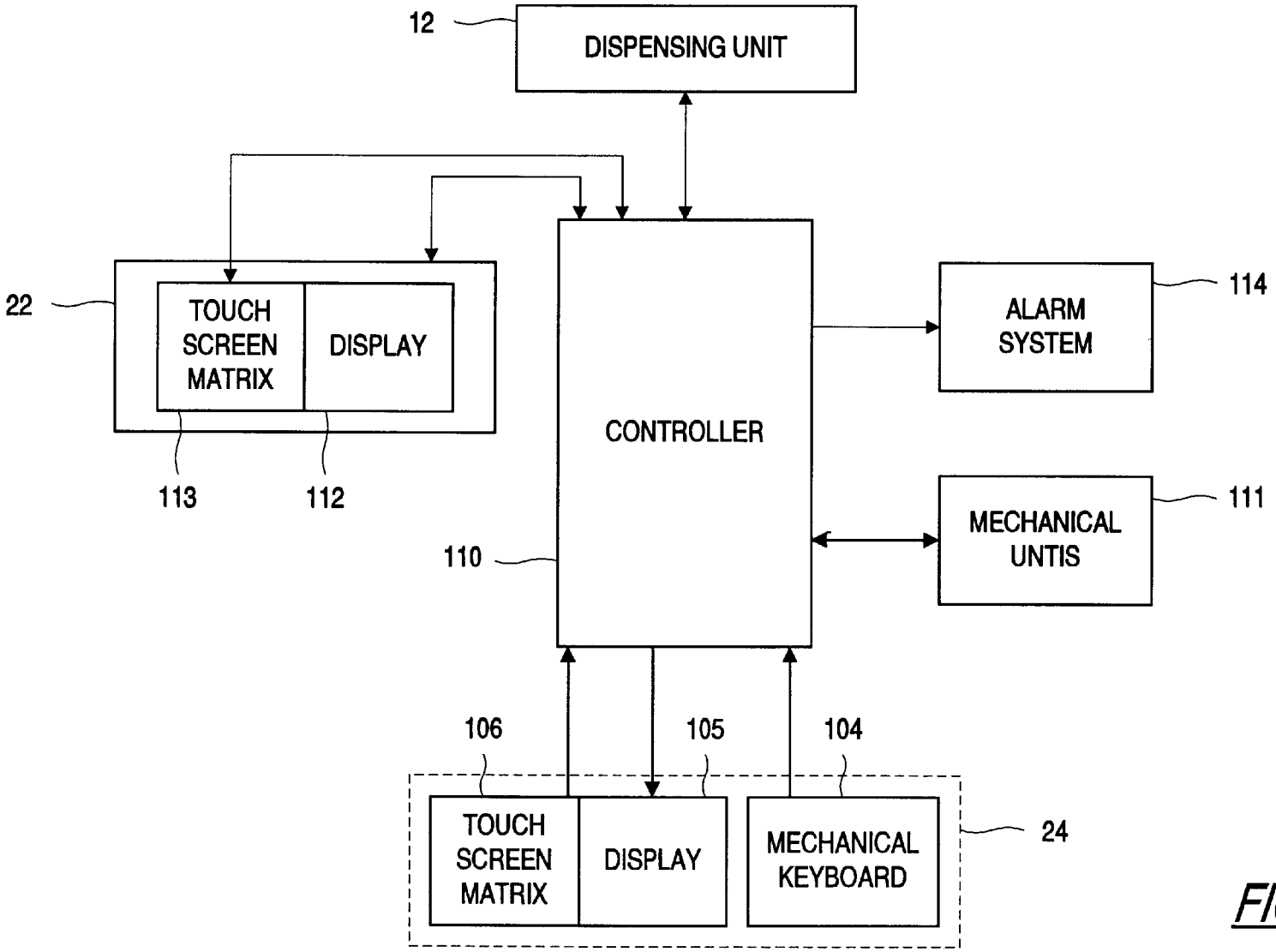
FIG. 4 is a block diagram of the controller and its relationship to other system components according to principles of the present invention.

FIG. 4 illustrates a system controller 110 and its relationship to the other components in the sorting and discriminating unit 11. The controller includes a timer, and counter for each of the denominations to be sorted. A main counter may also operate which counts the total number of coins counted by the coin sorter. The operator communicates with the coin sorter via the operator interface panel 24. The operator inputs information through the mechanical keyboard 104, or through the touch screen device matrix 106 of the touch screen 100. The graphics display 105, which is part of the touch screen device 100, is the component used by the controller 110 to inform the operator about the functions and operation of the coin sorter. The controller also communicates with mechanical operational units 111 which include an encode sensor, motor, count sensors, discrimination sensors, braking mechanisms, lubrication system, bag switching mechanisms, and a discriminator shunt system. The controller 110 communicates with the customer interface panel 22. The graphics display 112 informs the user about the functions and operation of the sorter while the customer inputs information via the touch screen matrix 113. The controller also communicates with the dispensing unit 12 using techniques that are well known to those skilled in the art. The controller also communicates an activates the alarm system 114 which, as described above, may be an external light, an audio alert system or both. Of course, the controller may cycle the backlighting of the display on the attendant display panel 24, as described above.

The touch screen device 100 allows the operator to enter three main modes: an operational mode, a set-up mode, and a diagnostics mode. Typically, the operator selects either the set-up mode or diagnostics mode when in the operational mode. When this occurs, the controller 110 is likewise placed into either of these modes.

When the controller 110 is in the set-up mode, the controller 110 causes the display 105 to initially display the set-up menu illustrated in FIGS. 5A and 5B. The primary display pattern provides, for example, the following set-up options: ENABLE KEYS, ENABLE FUNCTIONS, DATA ENTRY SELECTIONS, PORT SET-UP, DISCRIMINATOR LEARN, USER DEFAULTS, BOX/BAG CONFIGURATION, REPOSITION KEYS, KEY LEGENDS, SCREEN COMPLEXITY, and LUBRICATION. Additional set-up options are available as well. The key legends are located beside their respective keys, as opposed to within their respective keys, because the legends are too lengthy to fit within the keys.

Since the key legends occupy a relatively large portion of the display 105, all of the set-up options would not reasonably fit on a single primary display pattern. Therefore, the primary display pattern is divided into two portions which are separately displayed on the display 105 using the MORE and BACK keys. Only one of the two portions is shown on the display 105 at any given time. If FIG. 5A represents the portion of the primary display pattern currently on the display 105, the operator presses the MORE key to cause the display 105 to display the portion of the primary display pattern shown in FIG. 5B. Similarly, if FIG. 5B represents the portion of the primary display pattern currently on the display 105, pressing the BACK key causes the display 105 to display the portion of the primary display pattern shown in FIG. 5A. To modify the current settings of a particular set-up option in FIGS. 5A–5B, the operator presses the displayed key of that set-up option. Pressing the displayed key causes the controller 110 to display on the display 105 a secondary display pattern (sub-menu) for the option selected. To assist the operator in understanding the meaning of the various keys in the secondary display pattern, the secondary display pattern includes a HELP key. When the operator has completed his/her modifications to the current settings of the set-up option, the operator returns to the primary display pattern (main set-up menu) by pressing an EXIT key.

When the controller 110 is in the diagnostic test mode, the controller 110 causes the display 105 to initially display the primary display pattern (main diagnostics menu) illustrated in FIGS. 5*c*–5*d*. The primary display pattern provides, for example, the following diagnostic test options: MEMORY INFORMATION, ENCODER & COIN SENSORS, KEYBOARD, MOTOR, COIN THRUPUT, COIN STOP, BRAKE CYCLE, REMOTE DISPLAY, and MACHINE STATISTICS. Additional diagnostic options may be available as well. The key legends are located beside their respective keys, as opposed to within their respective keys, because the legends are too lengthy to fit within the keys.

Since the key legends occupy a relatively large portion of the display 105, all of the diagnostic test options would not reasonably fit on a single primary display pattern. Therefore, the primary display pattern is divided into two portions which are separately displayed on the display 105 using the MORE and BACK keys. Only one of the two portions is shown on the display 105 at any given time. If FIG. 5*c* represents the portion of the primary display pattern currently on the display 105, the operator presses the MORE key to cause the display 105 to display the portion of the primary display pattern shown in FIG. 5*d*. Similarly, if FIG. 5*d* represents the portion of the primary display pattern currently on the display 105, pressing the BACK key causes the display 105 to display the portion of the primary display pattern shown in FIG. 5*c*. To select a particular diagnostic test option in FIGS. 5*c*–5*d*, the operator presses the displayed key of that diagnostic test option.

Depending upon the selected diagnostic test, the controller 110 either automatically performs the selected diagnostic test or prompts the operator to enter numerical data (using the numeric keypad) prior to performing the diagnostic test. The prompts for data entry and the results of the selected diagnostic test are displayed on the display 105 as secondary display patterns. To assist the operator in performing the diagnostic tests, the secondary display pattern(s) associated with each diagnostic test include a HELP key. When the operator has completed a diagnostic test, the operator returns to the primary display pattern (main diagnostics menu) by pressing an EXIT key.

The operation of the customer touch screen 52 is now described. The touch screen is identical in construction (although it may have different dimensions) as the touch screen described above. During a transaction, the customer is prompted, using the display of FIG. 6*a*, to place coins in the tray of the machine and start processing. The user lifts the tray and the coins fall into the hopper. They can press "HELP" at any time during the process which stops the system and alerts the attendant, as described above Next, the customer is asked to lift the tray by displaying the screen shown in FIG. 6*b*. The customer then lifts the tray thereby pouring the coin into the counting chamber. The machine next indicates that coin is being counted using the screen of FIG. 6*c*. After the last coin is counted, the machine waits for a predetermined period (e.g. two seconds). After timing-out, the machine asks the customer if they wish to count more coin by displaying the screen shown in FIG. 6*d*. If the customer presses "yes," the machine goes back to the screen of FIG. 6*b*. If the customer presses "no," the machine displays the screen of FIG. 6*e*. This screen asks the user to press accept or to call for help. If "help" is pushed, the alarm is activated and an attendant help the customer, as described above. If "accept" is pressed, the screen of FIG. 6*f* is displayed. In this case, the dispensers are engaged and currency and coin, as appropriate, are returned to the customer by the dispensing unit 12. If at any time an error occurs "JETSORT® ERROR" is displayed, and the attendant is alerted as described above. If a communications error occurs, then "JETSORT® COMMUNICATIONS ERROR" is displayed.

Figure 6G:
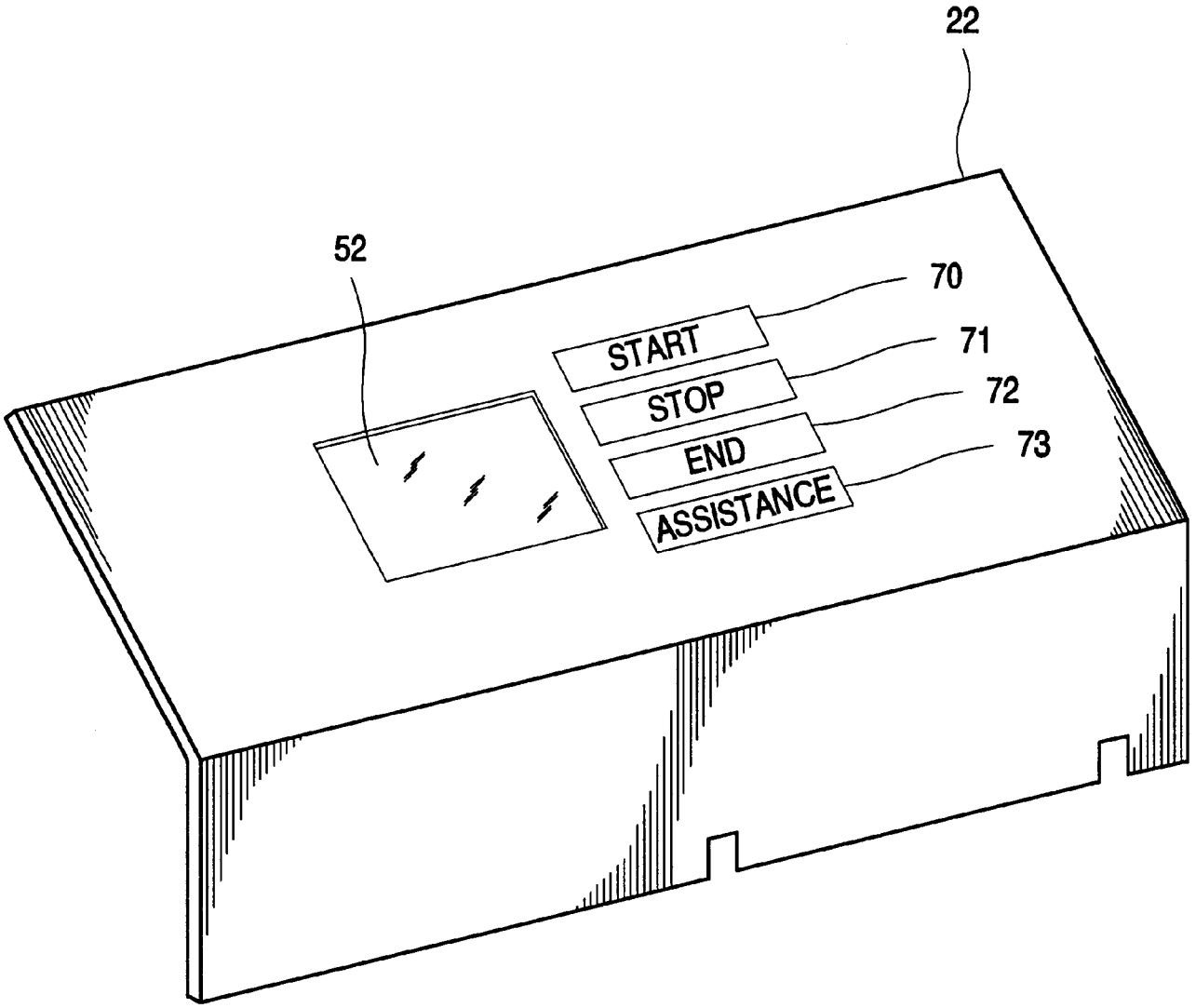
FIG. 6*g* is an alternative embodiment of the customer display panel according to principles of the present invention.

Alternatively, as shown in FIG. 6*g*, the customer panel 24 could include dedicated hard keys along with the touch screen. These keys include a "start" key 70 which is mounted next to the touch screen and would engage the system during an end batch condition or during a time out period during the processing of a batch. Additionally, a "stop" key 71 is mounted next to the touch screen and disengages the system any time a customer desires. Additionally, an "end" key 72 is mounted next to the touch screen which, when pushed, ends the transaction and engages the dispensing routines described below. Finally, an "assistance" key 73 is provided next to the touch screen which engages the alarms to that an attendant is alerted that the customer desires assistance. Although the customer panel 24 is above described having four keys, any number of keys can be used.

Figure 7A:
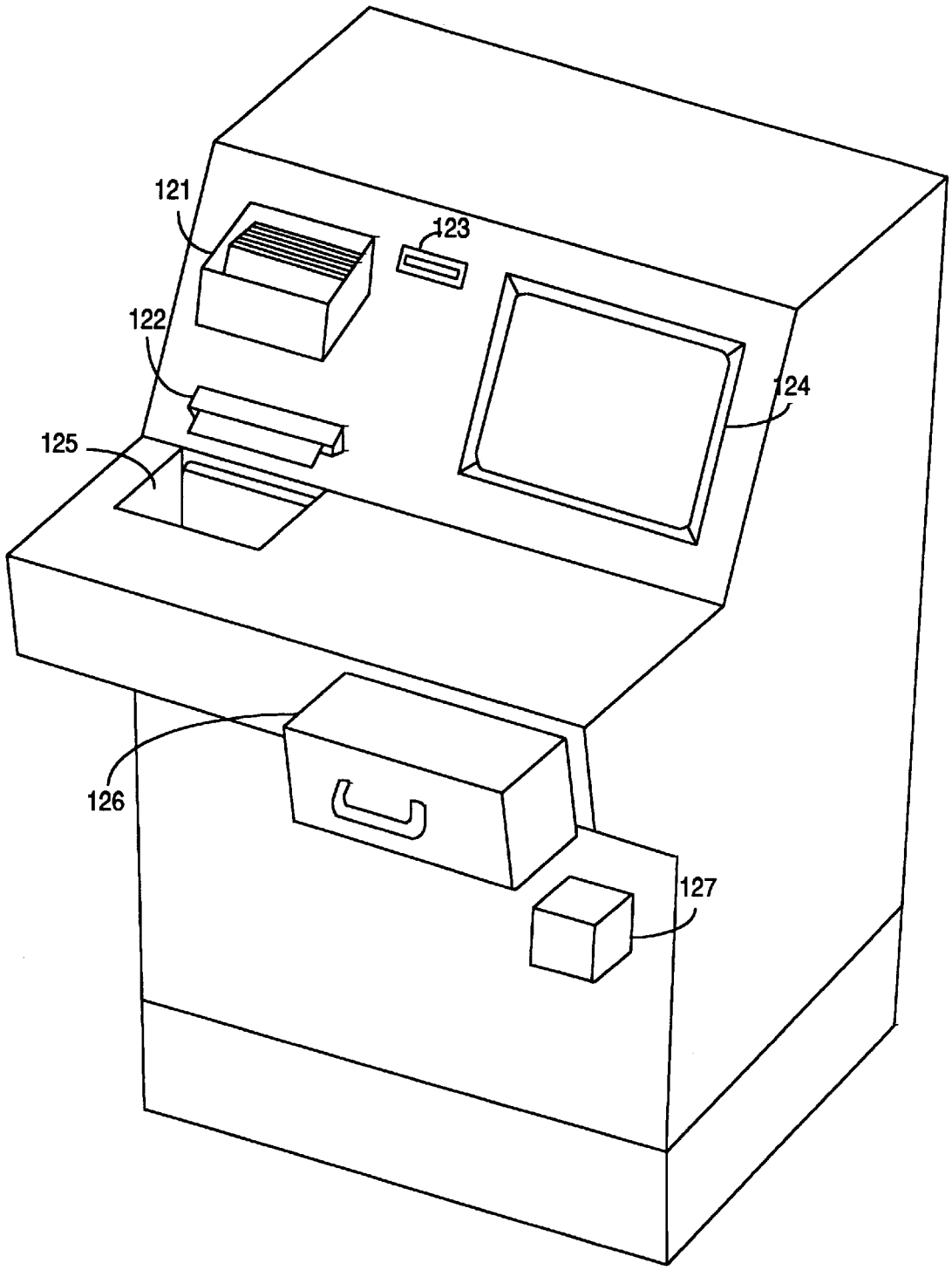
FIG. 7*a* is a perspective view of the unattended unit with touch screen according to principles of the present invention.
Figure 7B:
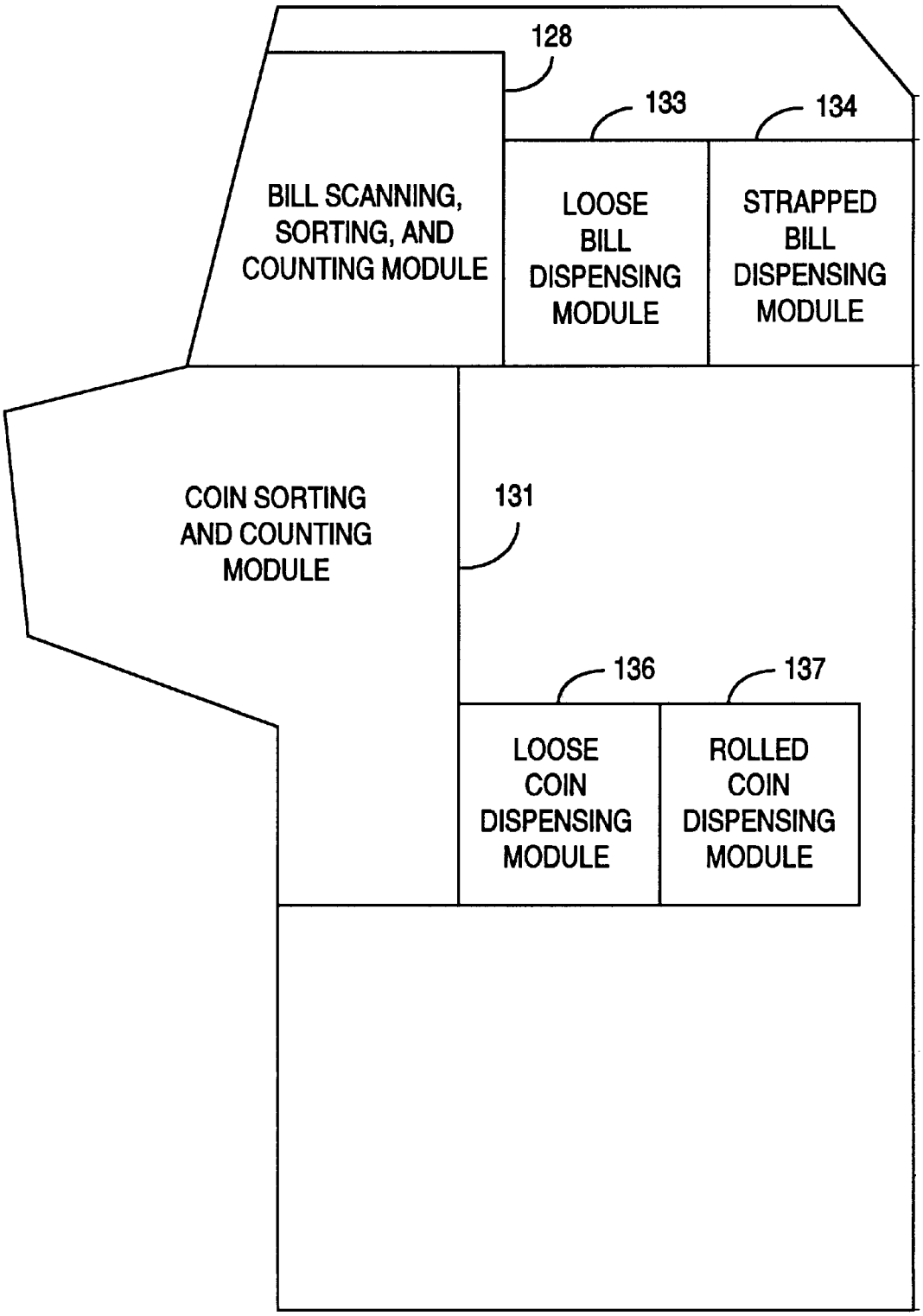
FIG. 7*b* is a view of the unattended unit with touch screen according to principles of the present invention.
Figure 7C:
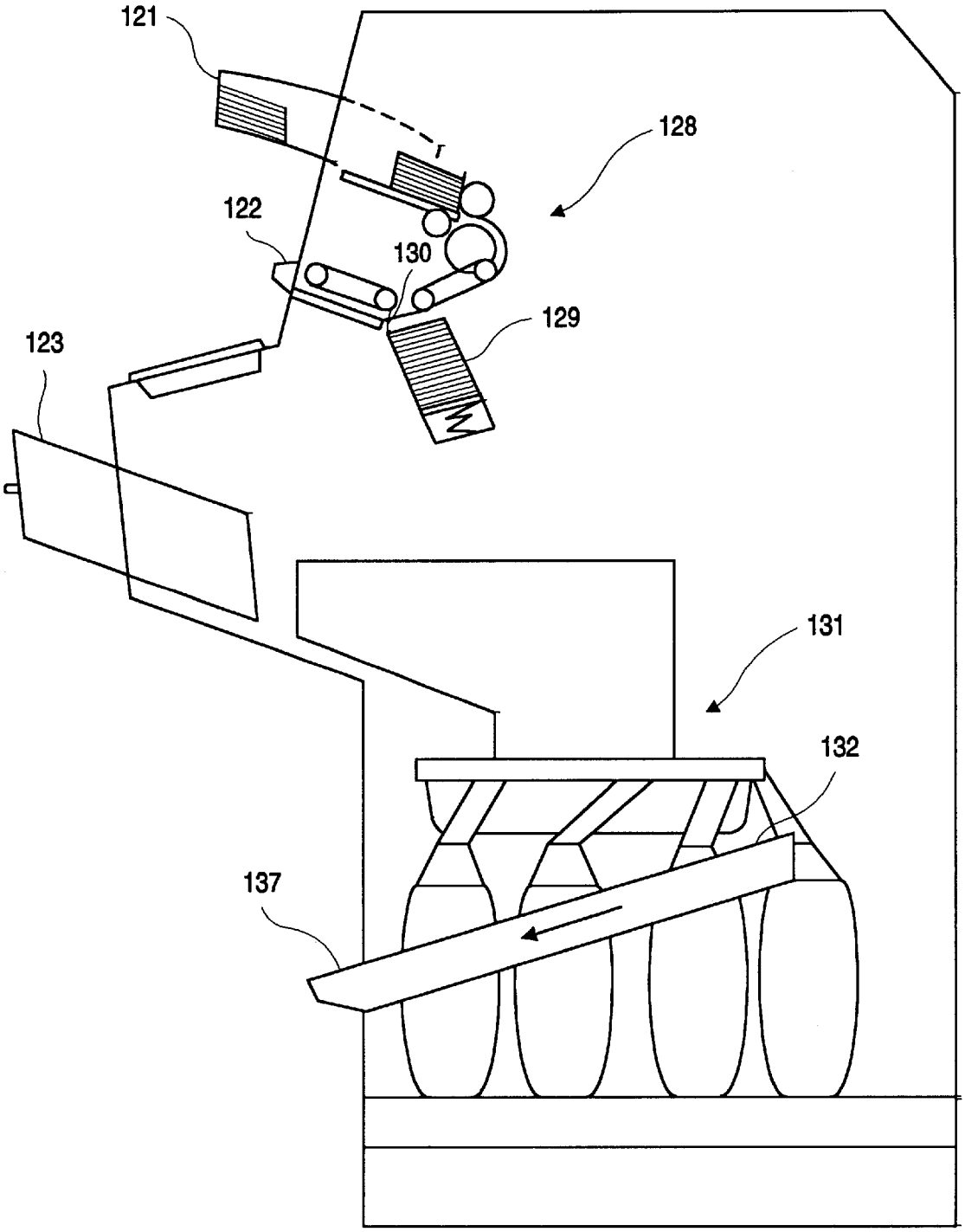
FIG. 7*c* is a view of the attended unit with touch screen unit according to principles of the present invention.

Referring now to FIGS. 7*a*, 7*b* and 7*c*, there is shown a funds processing system where the discrimination and dispensing functions are housed within a single unit and which includes a bill deposit receptacle 121 as well as a bill withdrawal or return slot 122. The system has a slot 123 for receiving a customer's identification card so that the data on the card can be automatically read by a media reader. This media reader would be capable of reading from or writing to various types of media which use a variety of information storage technologies such as magnetic storage media, solid state memory devices, and optical devices. A touch screen 124 provides the customer with a menu of options, and also prompts the customer to carry out the various actions required to execute a transaction by depressing keys on the touch screen.

The illustrative funds processing system also has a coin deposit receptacle 126 and a coin return pocket 127. The deposit receptacles 121 and 126 are normally retracted within the machine but are advanced to their open positions (shown in FIG. 7*a*) when a customer initiates a transaction. Bills and coins can then be deposited by the customer into the deposit receptacles 121 and 126, respectively. The receptacles also include trays (not shown) for removing foreign objects and liquids placed into the receptacles. Strapped currency can be dispensed into receptacle 125.

After the customer has placed a stack of bills into the receptacle 121, the customer is prompted to push that receptacle into the machine, to its retracted position. This inward movement of the receptacle 121 positions the stack of bills at the feed station of a bill scanning, sorting, and counting module 128 which automatically feeds, counts, scans, authenticates, and sorts the bills one at a time at a high speed (e.g., at least 350 bills per minute). The bills that are recognized by the scanning, sorting, and counting module 8 are delivered to a conventional currency canister 129 (FIG. 7*c*) which is periodically removed from the machine and replaced with an empty canister. When a bill cannot be recognized by the scanning module, a diverter 130 is actuated to divert the unidentified bill to the return slot 122 so that it can be removed from the machine by the customer. Alternatively, unrecognizable bills can be diverted to a separate currency canister rather than being returned to the customer. Bills that are detected to be counterfeit are treated in the same manner as unrecognizable bills. This module may be housed in a bank-rated vault.

Though not shown in FIGS. 7*a*–7*c*, the bill transport system may also include an escrow holding area where the bills being processed in a pending deposit transaction are held until the transaction is complete. Then if the declared balance entered by the customer does not agree with the amount verified by the machine, the entire stack of bills can be returned to the customer. If desired, this decision can be controlled by the customer via the keypad.

When coins are deposited by the customer in the receptacle 126, the customer again is prompted to push that receptacle into the machine. This causes the coins to be fed into the receiving hopper of a coin-sorting and counting module 131 which physically separates the coins by size (denomination) while separately counting the number of coins of each denomination in each separate transaction. The module 131 also includes a coin discriminator which detects coins that are counterfeit or otherwise non-genuine. These unacceptable coins are discharged from the sorter at a common exit, and the coins from that exit are guided by a tube 132 to the coin return slot 127. This module may also be housed in a bank-rated vault. The coin system may also include a escrow holding area as described below.

The funds processing system also preferably includes a conventional loose currency dispensing module 133 for dispensing loose bills, and/or a strapped currency dispensing module 134 for dispensing strapped currency, into a receptacle 135 at the front of the machine, in response to a withdrawal transaction. If desired, a loose coin dispensing module 136 and/or a rolled coin dispensing module 137, may also be included for dispensing coins via the coin return pocket 127. Additional modules that may be included in the system are modules for verifying and accepting checks, food stamps, tokens and/or tickets containing bar codes, smart cards, and other forms of customer script.

As will be described in more detail below, each of the modules 128 and 131 accumulates data representing both the number and the value of each separate currency item processed by these modules in each separate transaction. At the end of each transaction, this data and the account number for the transaction may be downloaded to an associated cash accounting system by a modem link, so that the customer's account can be immediately adjusted to reflect both the deposits and the withdrawals effected by the current transaction. Alternatively, the data from the currency-processing modules and the media reader can be temporarily stored within a temporary memory within the system, so that the data can be downloaded at intervals controlled by the computing system on which the cash accounting system is run.

Figure 8A:
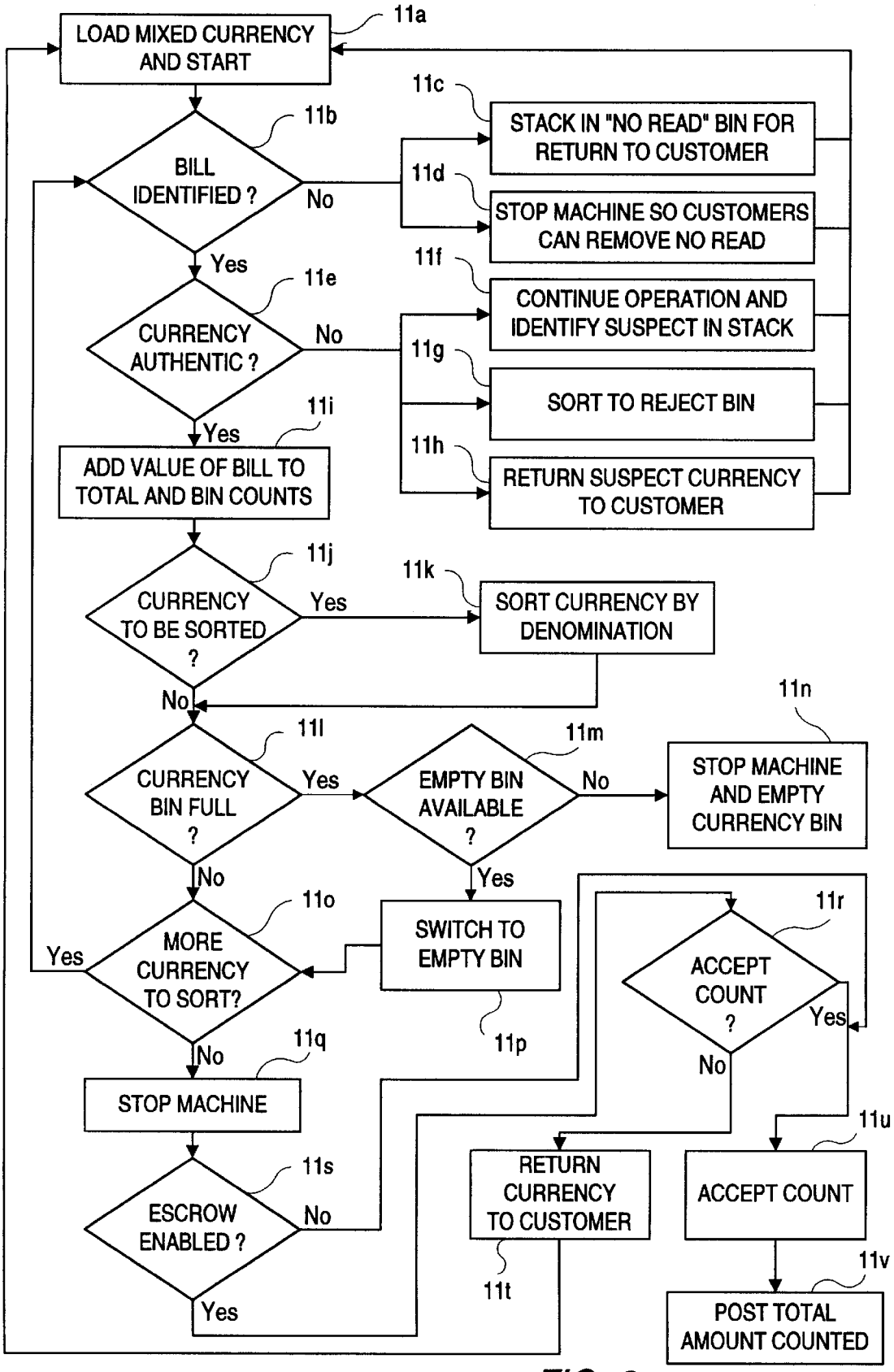
FIG. 8*a* is a flowchart of the bill sorting algorithm unit according to principles of the present invention.

The details of conducting a bill transaction are illustrated in FIG. 8*a*. The sorting and discriminating of bills is accomplished as described in U.S. Pat. No. 5,295,196 which is herein incorporated by reference in its entirety. The customer loads mixed bills at step 11*a* into the machine. This can be accomplished, as discussed above, by placing the bills in receptacle 121 on the machine. Next, still at step 11*a,* the customer initiates the processing of the bills. This can be accomplished, for example, by having the customer press a start key on the touch screen 124, as discussed above, to initiate a transaction.

If receptacle 121 is used together with touch screen 124, the machine can prompt the customer via a message on video screen 124, to push receptacle 126 into the machine, to its retracted position or the machine will automatically retract. The inward movement of the receptacle places the bills in the machine which automatically feeds, counts, scans, and authenticates the bills one at a time at a high speed (e.g., at least 350 bills per minute).

The machine attempts to identify a bill at step 11*b*. If step 11*b* fails to identify the bill, several alternatives are possible depending upon the exact implementation chosen for the machine. For example, if it fails to identify the bill, the system can use two canisters and place an unidentified bill in a "no read" currency canister. Alternatively, at step lid, the machine can be stopped so that the customer can remove the "no read" bill immediately. In this alternative, if a bill can not be recognized by the machine, the unidentified bill is diverted, for example, to a return slot so that it can be removed from the machine by the customer. After completing these steps, the system returns to step 11*b* to identify the other loaded bills.

In the event that the customer wishes to deposit "no read" bills that are returned to the customer, the customer may key in the value and number of such bills and deposit them in an envelope for later verification. A message on the display screen may advise the customer of this option. For example, if four $10 bills are returned, then re-deposited by the customer in an envelope, the customer may press a "$10" key four times. The customer then receives immediate credit for all the bills denominated and authenticated by the scanner. Credit for re-deposited "no read" bills is given only after a bank picks up the envelope and manually verifies the amount. Alternatively, at least preferred customers can be given full credit immediately, subject to later verification, or immediate credit can be given up to a certain dollar limit. In the case of counterfeit bills that are not returned to the customer, the customer can be notified of the detection of a counterfeit suspect at the machine or later by a written notice or personal call, depending upon the preferences of the financial institution.

If step 11*b* identifies the bill, next, at step 11*e,* the machine attempts to authenticate the currency to determine if the bill is genuine. The authentication process is described in greater detail below. If the bill is not genuine, then the system proceeds to one of three steps depending upon which option a customer chooses for their machine. At step 11*f*, the system may continue operation and identify the suspect currency in the stack. In this alternative, a single canister is used for all bills, regardless of whether they are verified bills, no reads, or counterfeit suspects. On the other hand, at step 11*g* the machine may outsort the currency, for example, to a reject bin. The machine may also return the suspect currency at step 11*h* directly to the customer. This is accomplished by diverting the bill to the return slot. Also, the machine maintains a count of the total number of counterfeit bills. If this total reaches a certain threshold value, the operator of the machine will be alerted. This may be accomplished, for example, by turning on a light on the machine.

As mentioned above, the system may use a single canister to hold the currency. If a single canister system is used, then the various bills are identified within the single canister by placing different colored markers at the top of different bills. These bills are inserted into the bill transport path so they follow the respective bills to be inserted into the canister. Specifically, a first marker, e.g., a marker of a first color, is inserted to indicate the bill is a counterfeit suspect that is not to be returned to the customer. A second type of marker, e.g., a marker of a second color, can be inserted to indicate that the bill is a counterfeit suspect. A third type of marker, e.g., of a third color, is inserted to indicate that a marked batch of bills represents a deposit whose verified amount did not agree with the customer's declared balance. Because this third type of marker identifies a batch of bills instead of a single bill, it is necessary to insert a marker at both the beginning and end of a marked batch.

If the currency is authenticated, the total count $B_{total}$ and bin count $B_{counti}$ (where "i" is the "ith" bin) are incremented at step 11*i*. The total count $B_{total}$ is used by the machine to establish the amount deposited by the customer and the bin counts are used to determine the amount of bills in a particular bin.

The machine then determines whether sorting is required at step 11*j*. If the answer is affirmative, then the currency is sorted by denomination at step 11*k*. Rather than using single or double bins, as described above, this option includes a bin for each denomination. Sorting is accomplished by bill scanning, sorting, and counting module 128 which sorts the bills placing each denomination in a specific bin. The sorting algorithm used can be any that is well known in the art.

After sorting at step 11*k* or if the answer to step 11*j* is negative, the machine proceeds to step 11*l*. At step 11*l*, the machine tests if the currency bin in use is full. That is, the machine compares $B_{counti}$ to the maximum allowed for a bin. If it is full, at step 11*m*, the machine determines if there is an empty currency bin. If there is no empty currency bin available, at step 11*m*, the machine stops. The currency is emptied at step 11*n*. If an empty currency bin exists, the machine switches to the empty bin and places the bill into that bin at step 11*p*.

At step 11*o*, the system determines when the last bill in the deposited stack of bills has been counted. If counting is complete, the machine is stopped at step 11*q*.

The bill transport system may also include an escrow holding area where the bills being processed in a pending deposit transaction are held until the transaction is complete. Thus, from step 11*q*, the system proceeds to step 11*s*, to determine if escrow has been enabled. If escrow has not been enabled, the count of the machine is accepted at step 11*u* and the total amount $B_{total}$ is posted to the customer at step 11*v*. If escrow has been enabled, at step 11*r*, the customer is given the choice of accepting the count. If the customer decides not to accept the count, at step 11*t*, the currency is returned to the customer. From step 11*t*, the machine proceeds to step 11*a* where the customer is given another chance of counting the currency. If the customer decides to accept the count at step 11*r*, the machine proceeds to step 11*u* where the count is accepted and step 11*v* where the total count is displayed to the customer. At this point, the bill counting transaction is complete.

Figure 8B:
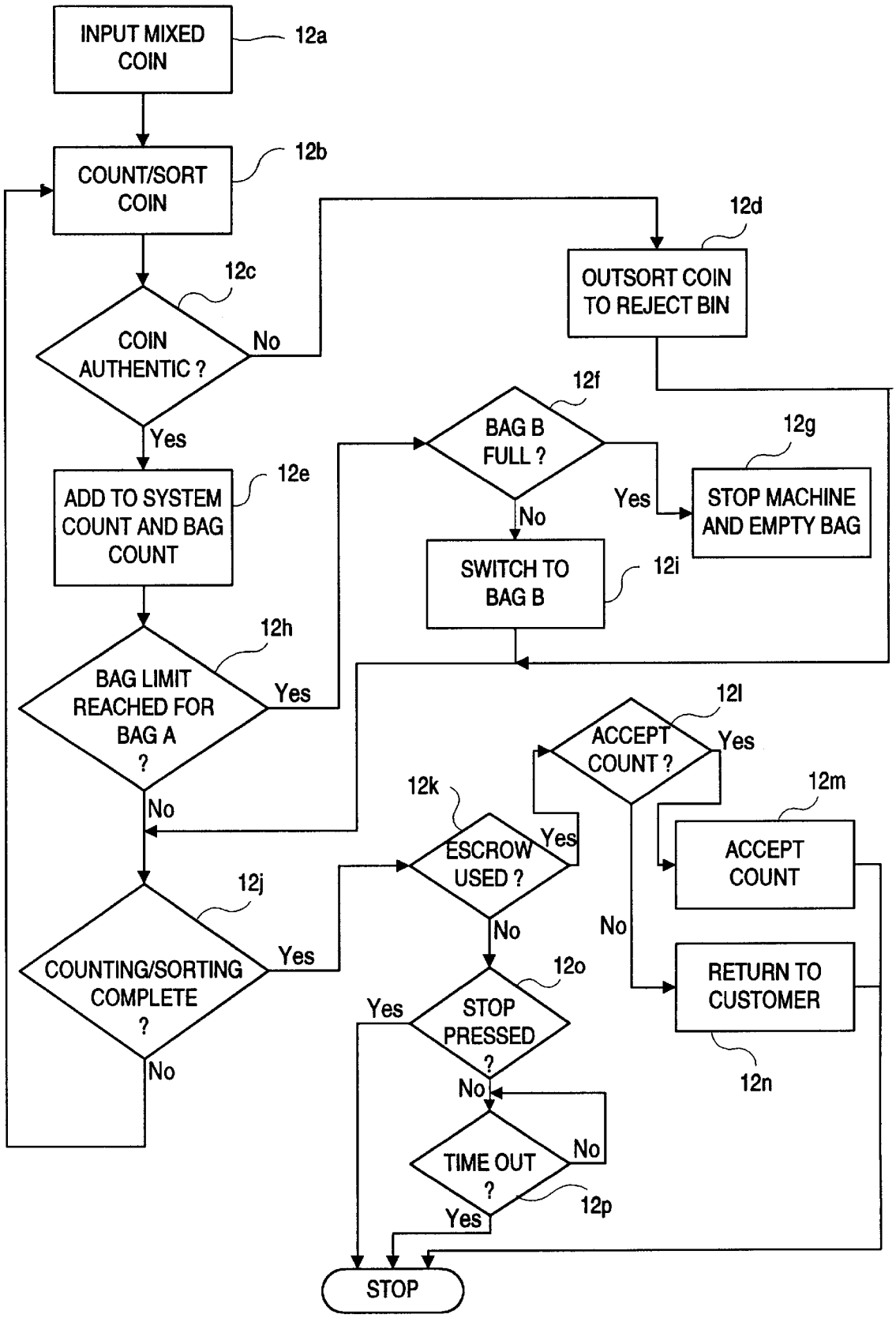
FIG. 8*b* is a flowchart of the coin sorting algorithm unit according to principles of the present invention.

A coin transaction is described in greater detail in FIG. 8*b*. As shown, a customer loads mixed coins into the system at step 12*a*. The coins are sorted, authenticated, and bagged one at a time. At step 12*b* the machine sorts the coin. The sorting process is described in greater detail below. At step 12*c*, the machine determines if the coin is authentic. This process is also described in greater detail below. If the coin is not authentic, the machine outsorts the coin to a reject bin at step 12*d* and then proceeds to step 12*i* and determines if counting and sorting is complete. The coin sorting and authentication process is the same as described above in reference to U.S. Pat. No. 5,542,880 which has been incorporated by reference in its entirety.

If the coin is authentic, the coin count $C_{total}$ and bag count $C_{bagi}$ (where "i" represents the "ith" bag) is incremented by one at step 12*e*. The system count $C_{total}$ represents the total value of the coins deposited while the bag count represents the number of coins in a bag. After sorting and authenticating the coin, the system attempts to place the coin in a bag at step 12*h*. All coins can be placed in one bag or one bag per denomination can be used. At step 12*h*, the system checks to see if the limit of the bag has been reached. That is, the system compares $C_{bagi}$ to the predetermined limit for a bag. If the limit has been reached for the bag in current use (e.g., bag A), the machine next checks to see if another bag (e.g., bag B) is full at step 12*f*. If bag B is full, the machine is stopped and an operator empties the bag at step 12*g*. If the other bag (e.g., bag B) is not full, then at step 12*i* the machine switches to this bag and the coin is placed there. The machine then proceeds to step 12*j* where a test is performed to determine if counting is complete.

At step 12*j*, the machine determines if sorting is complete. This is accomplished by sensing whether there are additional coins to sort in the coin bin. If sorting is not complete, the system continues at step 12*b* by counting and sorting the next coin.

If sorting has been completed, at step 12*k* the machine checks whether the escrow option has been enabled. If it has, at step 12*l*, the machine asks the customer whether they wish to accept the count. If the customer replies in the affirmative, at step 12*m* the machine accepts the count $C_{total}$ and posts the total to the customer. If the customer replies with a negative answer at step 12*l*, then the machine returns the coins to the customer at step 12*n* and the counting is complete.

If escrow has not been enabled, the machine checks at step 12*o* to see if stop has been pressed. If it has, the machine stops. If stop has not been pressed, then the machine waits for a certain period of time to time out at step 12*p* and stops when this time period has been reached.

Figure 8C:
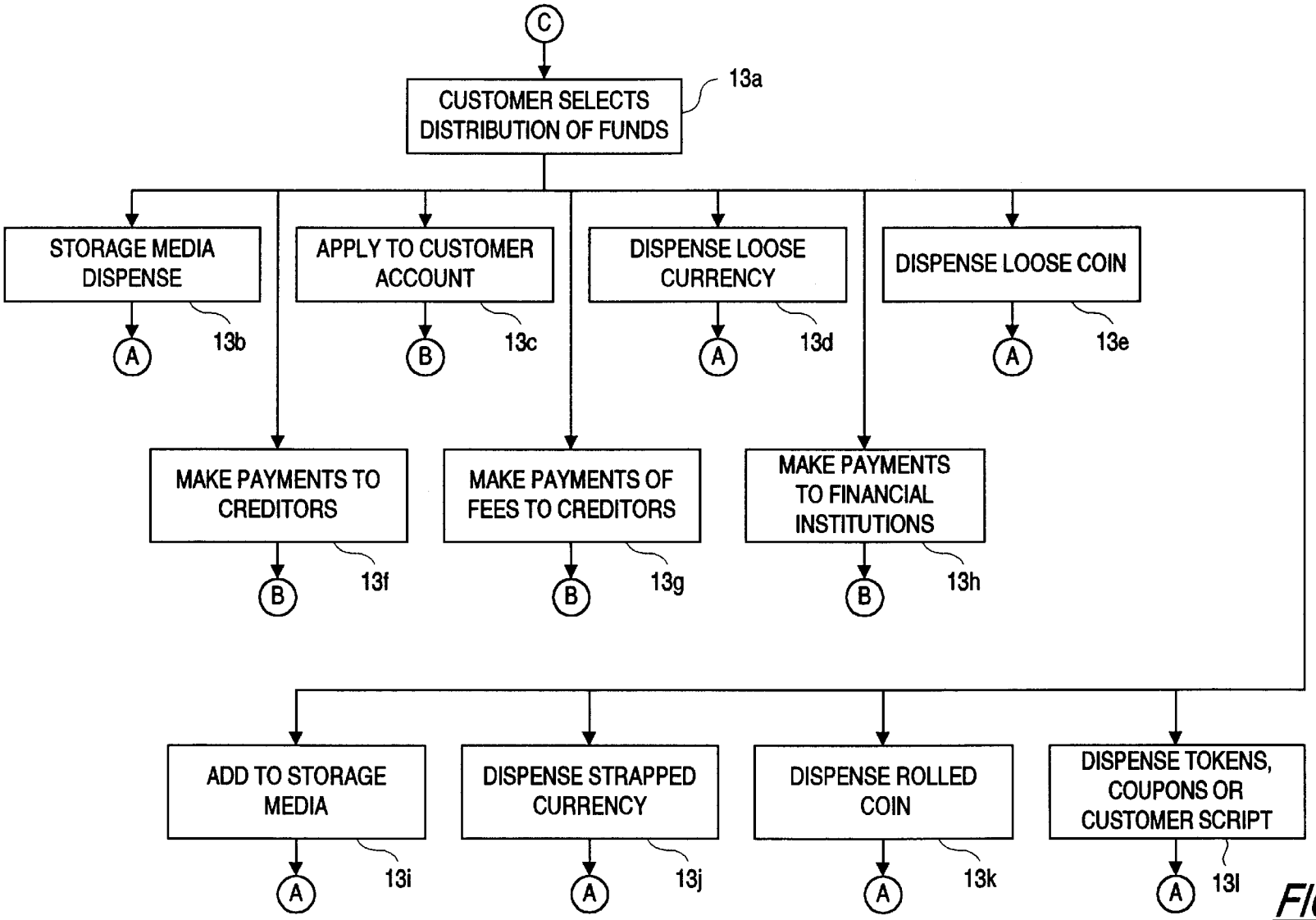
FIGS. 8*c,* 8*d,* and 8*e* are flowcharts of the funds distribution algorithm according to principles of the present invention.
Figure 8D:
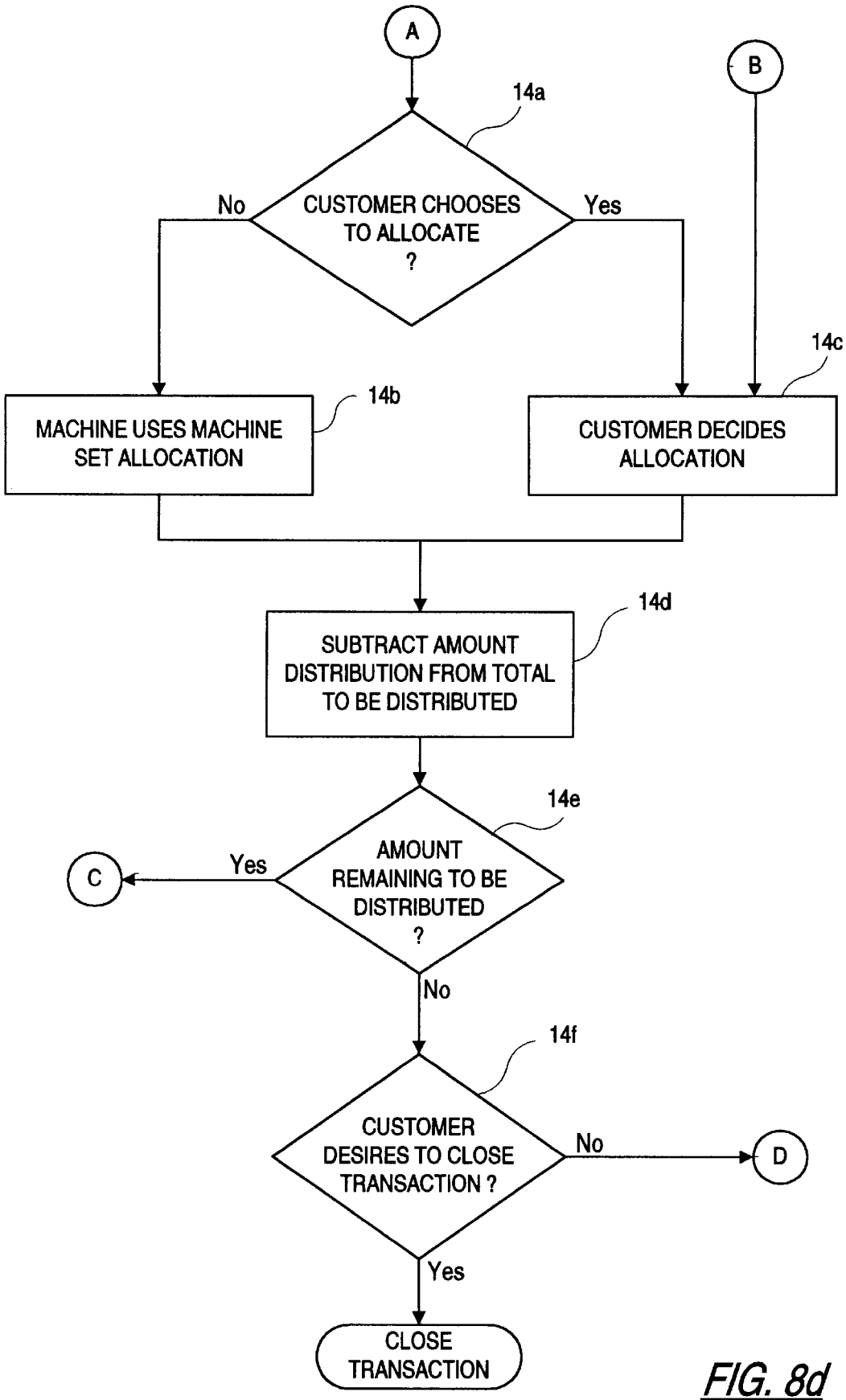
FIG. 8*f* is a flowchart of an alternate funds distribution algorithm according to principles of the present invention.
Figure 8E:
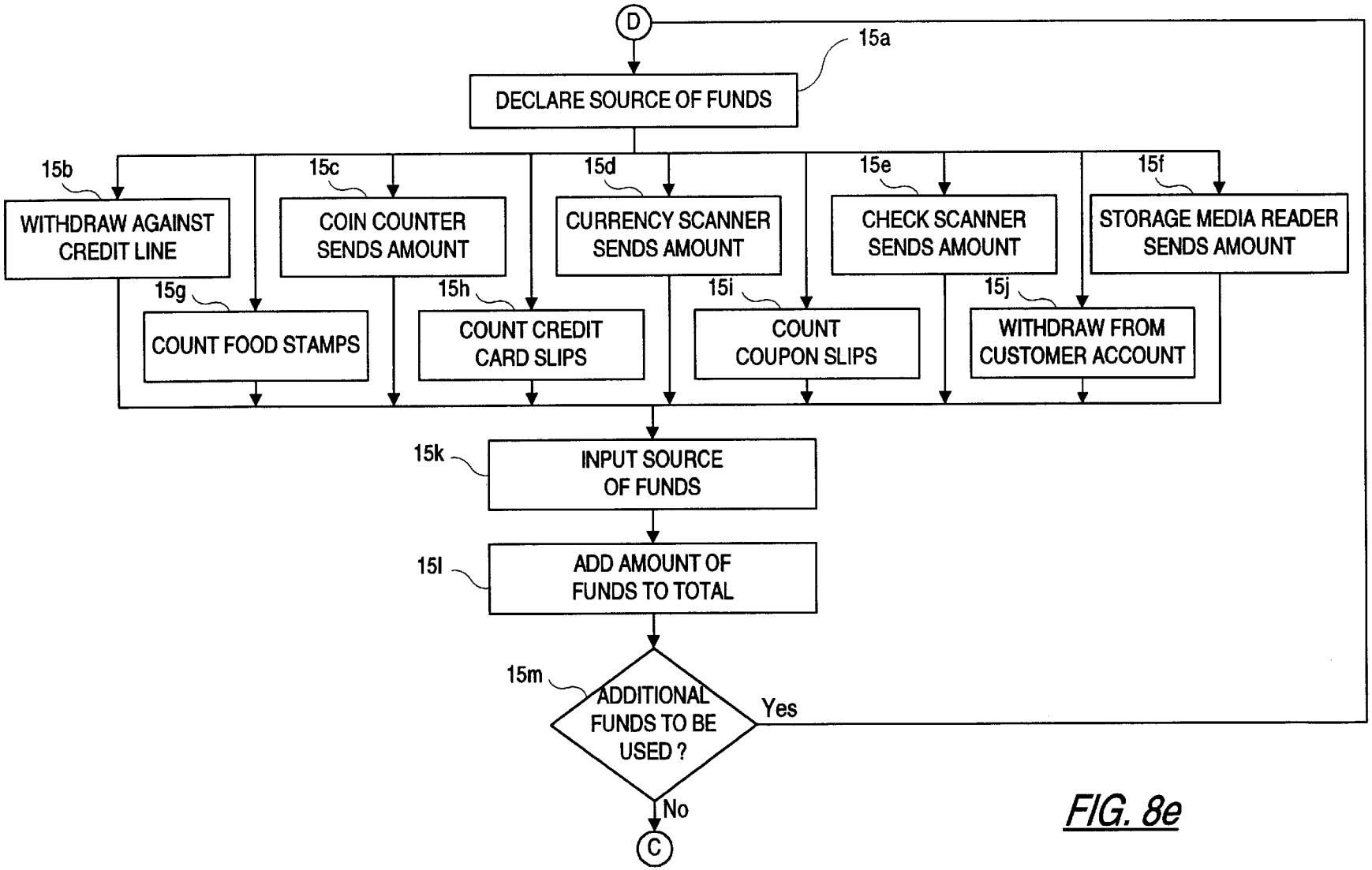

As mentioned previously, at step 10*c* of flowchart 1*a*, the customer allocates the amount deposited, whether the amount deposited is in the form of bills or coin. This step is illustrated in detail in FIGS. 8*c*, 8*d*, and 8*e*.

The machine inputs the funds at step 15*k* and sets $S_{total}$ (the total funds to be allocated) equal to either $C_{total}$ or $B_{total}$ at step 15*l*. The customer has the choice of adding more funds at step 15*m*. If the answer is affirmative, more funds are added. This process is described in detail below. If the answer is negative, the machine proceeds to step 13*a* with the customer selecting the amount and destination for the distribution of funds.

The customer is prompted by touch screen 52 to make these selections and can use the displayed keys on the screen to make the choices.

The customer then has several options for distribution destinations. The customer can choose to proceed to step 13*b* where an amount is transferred onto a some storage media, for example, a smart card, and the storage media is automatically dispensed to the customer. Another option, at step 13*c*, is to have an amount distributed to a customer account, for example, an account in a grocery store. Another choice is to distribute an amount in the form of loose currency to the customer at step 13*d* or loose coin at step 13*e*. The customer can also choose to distribute the amount to creditors at step 13*f* or make payment of fees to creditors at step 13*g*. The customer might make payment of fees to financial institutions at step 13*h*. These could include mortgage payments, for example. The customer can choose to add the amount to some form of storage media, for example, a smart card, at step 13*i*. The customer might also choose to dispense strapped currency at step 13*j*, rolled coin at step 13*k*, or in the form of tokens, coupons, or customer script at step 13*l*.

For some of the distribution selections, e.g. distribution of loose bills, the customer may wish to have certain denominations returned to him or may wish to accept a machine allocation. For example, the customer may choose to allocate a $100 deposit as four $20 bills, one $10 bill, and two $5 bills rather than accepting the default machine allocation. Those distributions where the customer has a choice of allocating the deposit themselves or accepting a machine allocation, follow path A. If the machine proceeds via path A, at step 14*a* the customer is asked whether they wish to allocate the amount. If the answer is affirmative, the customer will then decide the allocation at step 14*c*. However, if the answer at step 14*a* is negative, then the machine decides the allocation at step 14*b*. Machine allocation is appropriate for dispensing all forms of bills, coins, tokens, coupons, customer script and to storage media.

On the other hand, some distributions, e.g. deposits to bank accounts, require the customer to allocate the deposit. For example, for a $500 deposit, a customer may allocate $250 to a savings account and $250 to a checking account. Those distributions where the customer is required to allocate the amount deposited follow path B. If the machine proceeds via path B, at step 14*c* the customer decides the allocation. The machine then continues at step 14*c*.

After steps 14*c* or 14*d*, the machine proceeds to step 14*d* where the amount distributed is subtracted from the total amount deposited. At step 14*e*, the machine determines whether there is anything left to distribute after the subtraction. If the answer is affirmative, the machine proceeds to step 13*a* where the customer again decides a place to distribute the amount allocated.

At step 14*f*, the customer decides whether they wish to close the transaction. If they do, the transaction is closed. The closing completes step 10*c* of FIG. 1*a*. On the other hand, they may not wish to end the transaction. For example, they may wish to add more cash, coins, or credit from other sources. If this is the case, the machine proceeds to step 15*a* of FIG. 8*e*.

At step 15*a*, the customer decides which additional source of funds is to be used. The customer could choose, at step 15*b*, to withdraw funds from a credit line, for example, from a credit card or bank. The customer could choose to deposit more coins at step 15*c* or more bills at step 15*d*. These steps were discussed above. The customer could also choose to write a check and have this scanned in at step 15*e*, take a value from a form of storage media, for example, a smart card, at step 15*f*, add values from food stamps at step 15*g*, count credit card slips at step 15*h* or coupon slips at step 15*i*, or withdraw from a customer account at step 15*j*.

At step 15*k*, these additional funds are input into the system. For example, the algorithm illustrated in FIG. 8*a* is used to input an amount of additional funds from newly deposited bills and the algorithm of FIG. 8*b* is used to input additional value for newly deposited coin. At step 15*l*, this amount is added to the total amount of funds. At step 15*m*, the customer is given the choice of adding more funds. If the answer is affirmative, the system returns to step 15*a* where the customer declares the source of additional funds. If the answer is negative, the machine returns to step 13*a* in FIG. 8*c* where the customer is again asked to determine the distribution of the funds. The machine then proceeds as described above.

As described above, the customer can initiate a transaction by directly depositing funds from some form of storage media including all forms of magnetic, optical, and solid-state media. In the case of a storage media transaction, the customer may insert their media into a media reader so that it may be read. The machine then may prompt the user for the amount to be removed from the media and distributed to other sources. Conversely, the machine might remove all the funds available from the media. In any case, once the deposit amount has been removed from the media, the machine proceeds to step 15*k* in FIG. 8*e*. The remaining steps are the same as described above.

Also as described above, the customer can initiate a transaction by depositing funds from an outside source. By outside source, it is meant to include a credit card account, bank account, store account, or other similar accounts. The customer may initiate a transaction by using the touch screen to enter account information, such as the account number and PIN number to access the account. The customer might also initiate the transaction by moving an account identification card through a media reader, then using the touch screen to enter other data such as the amount to be withdrawn from the account. Then, the system proceeds to step 15*k* of FIG. 8*e*. The remaining steps are described are the same as described above.

Figure 8F:
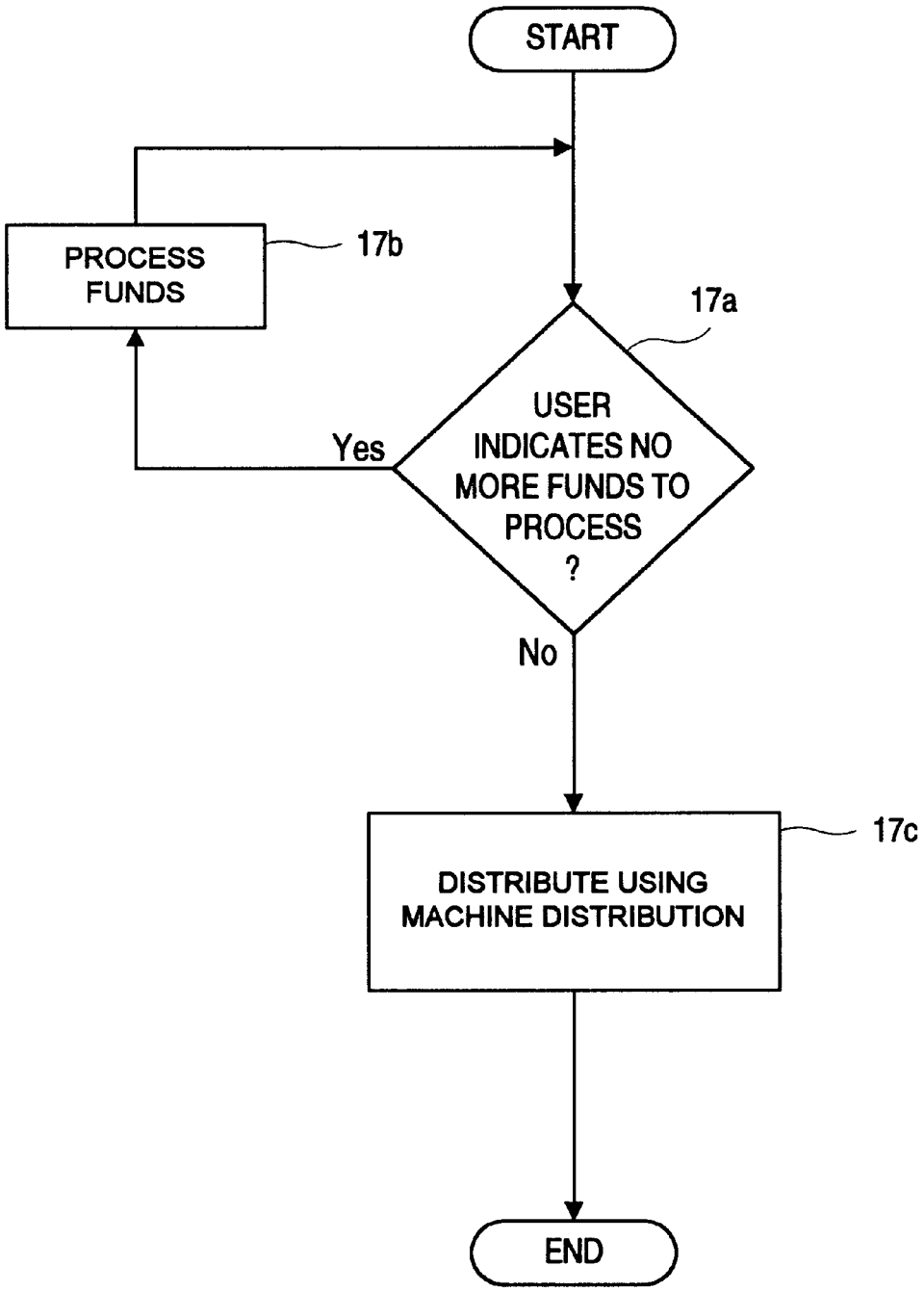

The alternate funds distribution algorithm is illustrated in FIG. 8*f*. At step 17*a*, the user indicates whether there are any more funds to process. If the answer is affirmative, at step 17*b*, the machine processes more funds. If the answer is negative, then at step 17*c*, the dispensing unit distributes the funds according to its programming. Operation of the machine then stops.

As described above, the funds processing system has the advantage of being able to accept mixed denominations of currency and coin. The system is configurable to allow both attendant and customer access while maintaining security. The system, by using touch screens, for example, is easy to use and maintain. The system also includes systems for preventing liquids and metallic debris from entering the system. Furthermore, the system processes the received deposit substantially immediately. In other words, the customer does not have to wait for a long period of time while the deposit is verified as occurs in typical ATM systems. Finally, the system is capable of depositing the received amount amongst remote locations and currency to the user.

We claim:

1. A funds discrimination and sorting system comprising:

acceptance means for accepting mixed funds from a customer;

sorting and discrimination means for sorting and discriminating said funds by denomination, said sorting and discrimination means coupled to said acceptance means;

customer interface means coupled to said sorting and discrimination means for accepting instructions from a customer, said instructions causing actuation of said system;

attendant control means for allowing an attendant to operate said system in a plurality of modes, said attendant control means positioned opposite and inaccessible to said customer;

wherein said acceptance means comprises a tray and a hopper;

wherein said acceptance means further comprises a hopper cover, said hopper cover connected to said hopper and pivoting simultaneously with said tray as said tray is lifted.

2. The funds discrimination and sorting system of claim 1 wherein said customer interface means comprises a touch screen.

3. The funds discrimination and sorting system of claim 1 wherein said acceptance means further comprises means for removing liquid from said tray.

4. The funds discrimination and sorting system of claim 1 wherein said acceptance means further comprises means for removing metallic debris from said tray.

5. The funds discrimination and sorting system of claim 1 wherein said funds include United States and foreign funds.

6. A coin discrimination system comprising:

coin discriminating and sorting means for counting and sorting coin;

a coin tray for holding said coin, said tray pivotal in an upward direction to a maximum height;

a hopper for receiving coin from said coin tray when said coin tray is pivotal to its maximum height, hollow connection means connected to said hopper at a first end and connected to said discriminating and sorting means at a second end, said connection means allowing said coin to pass from said hopper to said discriminating and sorting means;

a customer panel coupled to said discriminating and sorting means, said customer panel comprising means for starting and stopping said system and means for displaying operating instructions to a customer;

an attendant panel coupled to said discriminating and sorting means, said attendant panel inaccessible to the customer and having attendant communication means for permitting an attendant to operate the discriminating and sorting means in a plurality of modes; and a hopper cover, said hopper cover pivotably hinged to said hopper.

7. The coin discrimination system according to claim 6 wherein said hopper cover pivots simultaneously with said tray.

8. The coin discrimination system according to claim 6 wherein said hopper cover is hollow and is padded with a noise-reducing material.

9. The coin discrimination system of claim 6 wherein said customer panel comprises a touch screen.

10. The coin discrimination system of claim 6 wherein said coin tray further comprises means for removing liquid from said tray.

11. The coin discrimination system of claim 6 wherein said coin tray further comprises means for removing metallic debris from said tray.

12. The coin discrimination system of claim 6 wherein said coins include United States and foreign coins.

13. A coin discrimination system comprising:

coin discriminating and sorting means for counting and sorting coin;

a coin tray for holding said coin, said tray pivotal in an upward direction to a maximum height;

a hopper for receiving coin from said coin tray when said coin tray is pivotal to its maximum height, hollow connection means connected to said hopper at a first end and connected to said discriminating and sorting means at a second end, said connection means allowing said coin to pass from said hopper to said discriminating and sorting means;

a customer panel coupled to said discriminating and sorting means, said customer panel comprising means for starting and stopping said system and means for displaying operating instructions to a customer;

an attendant panel coupled to said discriminating and sorting means, said attendant panel inaccessible to the customer and having attendant communication means for permitting an attendant to operate the discriminating and sorting means in a plurality of modes; and wherein said hopper comprises a magnet for securing metallic debris.

14. A coin discrimination and currency and coin dispensing system comprising:

a coin discriminator and sorter for counting and sorting coin;

a coin tray for holding said coin, said tray pivotal in an upward direction;

a coin hopper for receiving coin from said coin tray when said coin tray is pivotal to its maximum height wherein said coin hopper includes magnetic holding means for securing metallic debris;

hollow connection means connected to said hopper at a first end and connected to said discriminator and sorter at a second end, said connection means allowing said coin to pass from said hopper to said discriminator and sorter, said hopper having a hopper cover, said hopper cover pivoting simultaneous with said tray and preventing access to said coin discriminator and sorter;

a customer panel comprising a touch screen, said touch screen accepting commands for starting and stopping said system and for displaying operating instructions to a customer;

an attendant panel inaccessible to the customer having a touch screen and keyboard permitting an attendant to operate the discriminating unit in a plurality of modes;

controller means coupled to said coin discriminator and sorter, said customer panel, and said attendant panel for operating said system in said plurality of modes;

means for removing liquid from said coin tray;

alarm means coupled to said controller, said alarm means responsive to said commands for stopping of said system by the customer, said alarm means for alerting an attendant;

means for removing debris from said tray; and a dispensing unit for dispensing currency and coin to a user, said unit coupled to said controller, said controller activating said dispensing unit to dispense currency to a customer.

15. A method of discriminating and sorting funds comprising the steps of:

accepting mixed funds from a customer;

sorting and discriminating said funds by denomination;

accepting instructions from a customer, said instructions causing actuation of said system;

allowing an attendant to operate said system in a plurality of modes;

supplying a tray and a hopper for accepting said funds and a hopper cover;

connecting said hopper cover to said hopper and such that said hopper cover pivots simultaneously with said tray as said tray is lifted.

16. A method for discriminating coin comprising the steps of:

counting and sorting coin;

holding said coin in a coin tray, said tray pivotal in an upward direction to a maximum height;

receiving coin from said coin tray in a hopper when said coin tray is pivotal to its maximum height;

supplying a discriminator and sorter;

allowing said coin to pass from said hopper to said discriminator and sorter;

coupling a customer panel to said discriminator and sorter, said customer panel starting and stopping said system and displaying operating instructions to a customer;

coupling an attendant panel to said discriminator and sorter, said attendant panel inaccessible to the customer and permitting an attendant to operate the discriminator and sorter means in a plurality of modes; and supplying a hopper cover, and pivotably hinging said hopper cover to said hopper.

* * * * *